US007064479B2

(12) United States Patent
Nakata et al.

(10) Patent No.: US 7,064,479 B2
(45) Date of Patent: Jun. 20, 2006

(54) COLD CATHODE DISPLAY DEVICE AND METHOD OF MANUFACTURING COLD CATHODE DISPLAY DEVICE

(75) Inventors: Shuhei Nakata, Tokyo (JP); Kunihiko Nishimura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 240 days.

(21) Appl. No.: 10/485,853

(22) PCT Filed: Mar. 26, 2003

(86) PCT No.: PCT/JP03/03754

§ 371 (c)(1),
(2), (4) Date: Feb. 5, 2004

(87) PCT Pub. No.: WO03/085692

PCT Pub. Date: Oct. 16, 2003

(65) Prior Publication Data

US 2004/0232823 A1 Nov. 25, 2004

(30) Foreign Application Priority Data

Apr. 11, 2002 (JP) ..... 2002-108661

(51) Int. Cl.
*H01J 1/62* (2006.01)

(52) U.S. Cl. ..... 313/497; 313/495

(58) Field of Classification Search ..... 313/495–497
See application file for complete search history.

(56) References Cited

U.S. PATENT DOCUMENTS 5,903,092 A 5/1999 Akama
6,137,213 A * 10/2000 Moyer et al. ..... 313/309
6,236,381 B1 5/2001 Kurata et al.
6,278,228 B1 * 8/2001 Iwase et al. ..... 313/306

FOREIGN PATENT DOCUMENTS

| | | |
|---|---|---|
| EP | 0 614 209 | 2/1994 |
| JP | 54-71558 | 6/1979 |
| JP | 7-6714 | 1/1995 |
| JP | 8-329823 | 12/1996 |
| JP | 11-224617 | 8/1999 |
| JP | 11-233044 | 8/1999 |
| JP | 2000-3664 | 1/2000 |
| JP | 2000-90861 | 3/2000 |
| JP | 2001-155666 | 6/2001 |
| JP | 2001-195972 | 7/2001 |
| JP | 2001-202909 | 7/2001 |
| JP | 2001-319560 | 11/2001 |

* cited by examiner

*Primary Examiner*—Mariceli Santiago
*Assistant Examiner*—Anthony Perry
(74) *Attorney, Agent, or Firm*—Leydig, Voit & Mayer, Ltd.

(57) ABSTRACT

A cold cathode display device which has a small thickness and a large display area, in which an anode can be sufficiently distant from an extraction electrode to ensure a breakdown voltage and an electron beam diameter can be made sufficiently smaller than the size of a phosphor, and a method of manufacturing such a cold cathode display device. A focus electrode is added to a conventional cold cathode display device. The focus electrode is located such that extraction electrodes and cathodes are interposed between the focus electrode and a back substrate. The focus electrode includes electron passage windows located opposite the cathodes and electron passage windows. The focus electrode is attached to, and supported by, the extraction electrodes via an insulating material with a distance being maintained between the focus and extraction electrodes.

9 Claims, 17 Drawing Sheets

COLD CATHODE DISPLAY DEVICE AND METHOD OF MANUFACTURING COLD CATHODE DISPLAY DEVICE

TECHNICAL FILED

The present invention relates to a cold cathode display device, and more particularly to a cold cathode display device having a small thickness and a large display area.

BACKGROUND ART

A cold cathode display device is a display device which causes electrons emitted from an electron emitting part thereof to collide with a phosphor in a space formed by disposing a pair of substrates, at least one of which is transparent, opposite to each other, thereby displaying a desired pattern. FIG. 13 illustrates a structure of a conventional cold cathode display device.

A back substrate 101 and a face substrate 102 are disposed opposite to each other with a spacer 103 interposed therebetween, to form a chamber. The chamber is evacuated. Each of the back substrate 101 and the face substrate 102 is attached to the spacer 103 by glass frit 104, and at least a portion of the face substrate 102 which serves as a display surface is required to be transparent in view of properties of a cold cathode display device. A light emitting part is formed on an inner side of the face substrate 102 in order to display a desired pattern. The light emitting part is formed by depositing a phosphor 108 on a transparent electrode 109 serving as a positive electrode (, which part will hereinafter be also referred to as an "anode").

On the other hand, an electron emitting part is formed on an inner side of the back substrate 101, so as to be opposite to the anode. The electron emitting part is formed by depositing a cold cathode material 106 on a substrate electrode 105 serving as a negative electrode (, which part will hereinafter be also referred to as a "cathode"). While a filament has conventionally been employed as such an electron emitting part, a conductive layer including a carbon nanotube which can be manufactured by a printing process has become used as a material for a field emission type cold cathode, recently. Reasons for recent use of a conductive layer including a carbon nanotube as an electron source are higher brightness and a longer life time as compared to those provided by use of a filament. Also, as a conductive layer can be manufactured by a printing process, low cost manufacture is possible. Meanwhile, details of a technique for employing a conductive layer including a carbon nanotube as a material for a field emission type cold cathode are provided in Japanese Patent Application Laid-Open No. 2001-155666.

Further, an extraction electrode 107 for controlling electrons is provided between the anode and the cathode. The extraction electrode 107 has many apertures through which electrons emitted from the cathode pass, the apertures being located at positions at which the extraction electrode 107 and the cathode intersect each other. The extraction electrode 107 is configured such that a leg portion, formed by bendin6fritg a portion of the extraction electrode 107, is attached to the back substrate 101 by glass frit, and is secured to the back substrate 101. There is a need of externally supplying a potential to the extraction electrode 107. For this reason, the extraction electrode 107 is connected to a copper wire electrode 110, a portion of which penetrates the glass frit 104 to protrude from the chamber, within the chamber. As there is a need of externally supplying a potential also to each of the substrate electrode 105 and the transparent electrode 109, each of the substrate electrode 105 and the transparent electrode 109 is connected to the copper wire electrode in an analogous manner to the extraction electrode 107. It should be noted that FIG. 13 illustrates only connection between the extraction electrode 107 and the copper wire electrode 110.

Next, principles of operations of the cold cathode display device will be explained. Basically, operations of the cold cathode display device are similar to those of a triode. Upon application of a potential to the substrate electrode 105 of the cathode within the chamber holding therein a vacuum with a pressure in a range between approximately $10^{\square 3}$ and $10^{\square 5}$ Pa, electrons are emitted from the cold cathode material 106. The emitted electrons are controlled by the extraction electrode 107, and are accelerated because of a potential difference between the transparent electrode 109 of the anode and the substrate electrode 105 of the cathode. The accelerated electrons reach the phosphor 108 of the anode, and excite the phosphor. The excited phosphor emits light when returning to a normal energy state. The cold cathode display device provides a desired display by utilizing the light emission of the phosphor.

The conventional cold cathode display device is a simple triode which is composed of an anode, an extraction electrode and a cathode. With this composition, the following problems have been caused.

A structure of the extraction electrode of the conventional cold cathode display device has been designed to have an optimum diameter of the aperture in the extraction electrode, an optimum plate thickness of the extraction electrode and an optimum distance between the extraction electrode and the cathode, taking into account mainly an extraction voltage and an extraction efficiency. However, optimization of a diameter of the aperture in the extraction electrode, a plate thickness of the extraction electrode and a distance between the extraction electrode and the cathode could not allow sufficient reduction of a size of electrons (which will hereinafter be also referred to as an "electron beam") emitted from the cathode, which is measured on a surface of the anode. As such, a distance which the electron beam travels until it reaches the surface of the anode should be reduced, thereby making the size of the electron beam as measured on the surface of the anode (which will hereinafter be also referred to an "electron beam diameter") smaller than a size of the phosphor of the anode. This requires a distance between the anode and the extraction electrode to be reduced.

Due to the requirement that the distance between the anode and the extraction electrode be reduced, a voltage which can be applied between the anode and the extraction electrode is limited, so that a high voltage can not be applied. Being unable to apply a high voltage to the anode results in a failure to sufficiently enhance an efficiency in light emission of the phosphor. This causes a problem of non-achievement of a cold cathode display device providing a satisfactory brightness.

The requirement that the distance between the anode and the extraction electrode be reduced, on the other hand, results in reduction of a distance between the cathode and the anode. Accordingly, there is a need for configuring the cold cathode display device to have a ratio of approximately 1:1 between a size of the electron emitting part of the cathode and a size of the phosphor of the anode. As a result, in a situation where a voltage on the extraction electrode is varied in order to adjust a current value so that a degree of convergence in the vicinity of the extraction electrode is varied to further vary an electron beam diameter, the variation in electron beam diameter directly affects light emission of the phosphor of the anode, resulting in variation in brightness among pixels.

Moreover, the requirement that the distance between the anode and the extraction electrode be reduced makes a required level of an accuracy in assembling, high. A low accuracy in assembling results in positional shift of an electron beam, to bring about emission of mixed colors in which another phosphor located next to an intended phosphor emits light. This causes a problem of degradation in color purity.

A further problem of localization of electrons in emission thereof from a surface of the cathode is caused. Causes of this problem are as follows. In a typical cold cathode electron source, emission characteristic thereof is determined by a strength of an electric field and a work function of an uneven surface of a cathode with protrusions. However, an electric field strength is very responsive to respective configurations of the protrusions. Even if a work function of the surface of the cathode can be made uniform in some way, it is technically difficult to planarize the surface of the cathode with an accuracy on the order of μm or smaller. Accordingly, variation in height among the protrusion of the surface of the cathode is unavoidable, to allow an amount of electrons emitted from the cathode to depend greatly on an electric field of the surface of the cathode. Hence, there are created a portion which can easily emit electrons and a portion which can not easily emit electrons due to subtle variation in configuration among the protrusions in the surface of the cathode. In the portion which can easily emit electrons, a current value increases exponentially in accordance with an increase of the electric field of the surface after electron emission is initiated. As a result, localization of an electron emitting region occurs on the surface of the cathode so that light emitting points are interspersed like dots in a pixel which is lighted up, which causes a problem of degrading an image quality.

DESCRIPTION OF THE INVENTION

It is an object of the present invention to solve the foregoing problems and provide a structure of a cold cathode display device in which an anode can be sufficiently distant from an extraction electrode to ensure a breakdown voltage, an electron beam diameter can be made sufficiently smaller than a size of a phosphor, and light emitting points of a pixel can be prevented from being interspersed like dots, thereby suppressing degradation of an image quality, as well as a method of manufacturing such a cold cathode display device.

According to the present invention, a cold cathode display device includes: a pair of substrates of first and second substrates which are disposed opposite to each other so as to form a space therebetween which is evacuated, at least a display portion of the second substrate serving as a display surface being transparent; a light emitting part which is disposed at a predetermined position on a side of the second substrate on which the space is formed, and includes a positive electrode and phosphors provided on the positive electrode; an electron emitting part which is disposed on a side of the first substrate on which the space is formed so as to be opposite to the light emitting part, and emits an electron upon application of a predetermined potential; an extraction electrode provided between the electron emitting part and the light emitting part, for controlling the electron emitted from the electron emitting part; and a focus electrode which is provided between the light emitting part and the extraction electrode, and is,provided with windows through which the electron emitted from the electron emitting part pass.

The cold cathode display device according to the present invention allows an anode to be sufficiently distant from an extraction electrode to ensure a breakdown voltage, allows an electron beam diameter to be sufficiently reduced as compared to a size of a phosphor, and prevents light emitting points of a pixel from being interspersed like dots to degrade image quality.

These and other objects, features, aspects and advantages of the present invention will become more apparent from the following detailed description of the present invention when taken in conjunction with the accompanying drawings.

BEST MODE FOR CARRYING OUT THE INVENTION

1. FIRST PREFERRED EMBODIMENT

Figure 1:
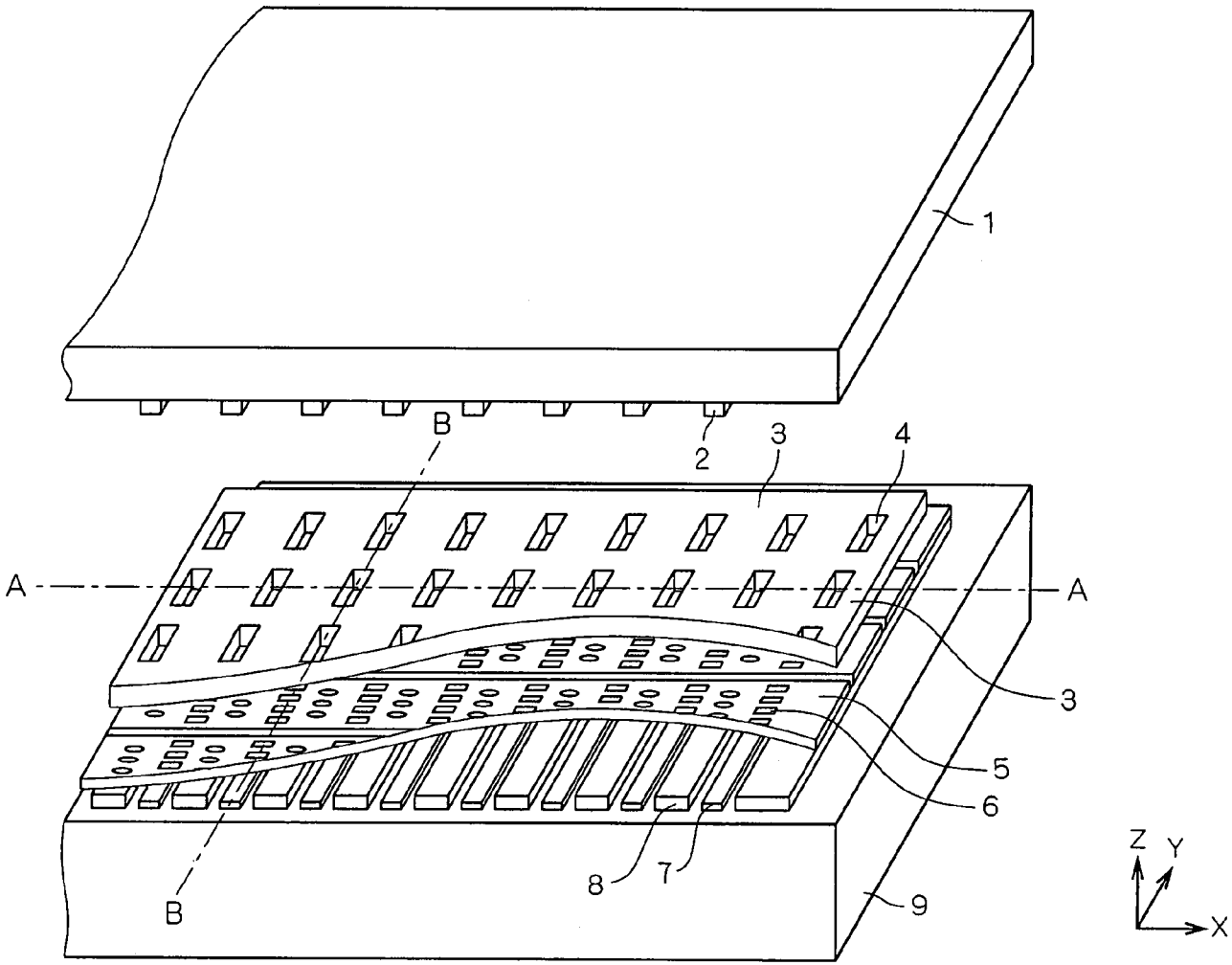
FIG. 1 is a perspective view of a cold cathode display device according to a first preferred embodiment of the present invention.
Figure 2:
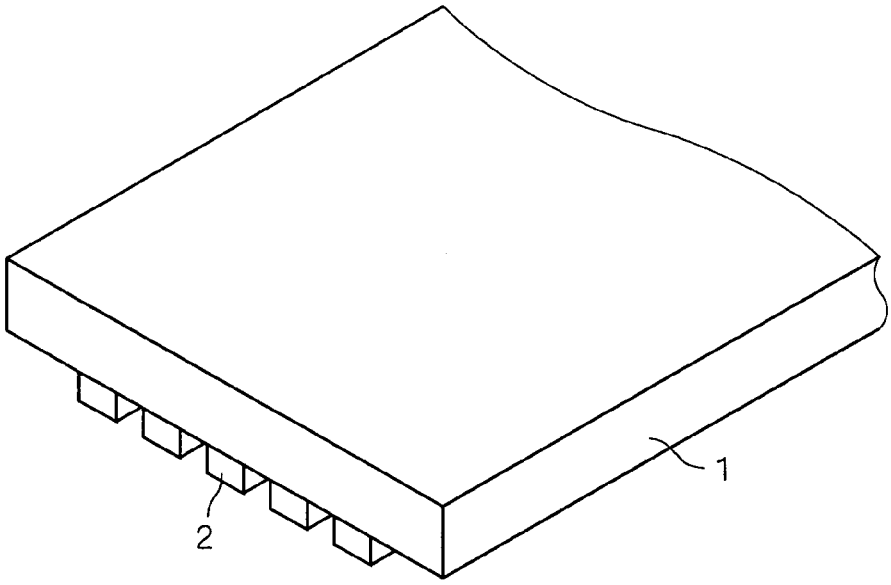
FIG. 2 is a perspective view of a face substrate and anodes according to the first preferred embodiment of the present invention.

FIG. 1 is a perspective view of a cold cathode display device according to a first preferred embodiment. First, a structure of a face substrate 1 according to the first preferred embodiment is similar to that of the face substrate of the conventional cold cathode display device. Anodes 2 are provided on the face substrate 1 in accordance with a predetermined pattern to be displayed. According to the first preferred embodiment, the anodes 2 are arranged in stripes. FIG. 2 is an enlarged view of the face substrate 1 and the anodes 2. It is noted that each of the anodes 2 is formed by depositing a phosphor on a transparent electrode serving as a positive electrode formed on the face substrate 1.

Figure 3:
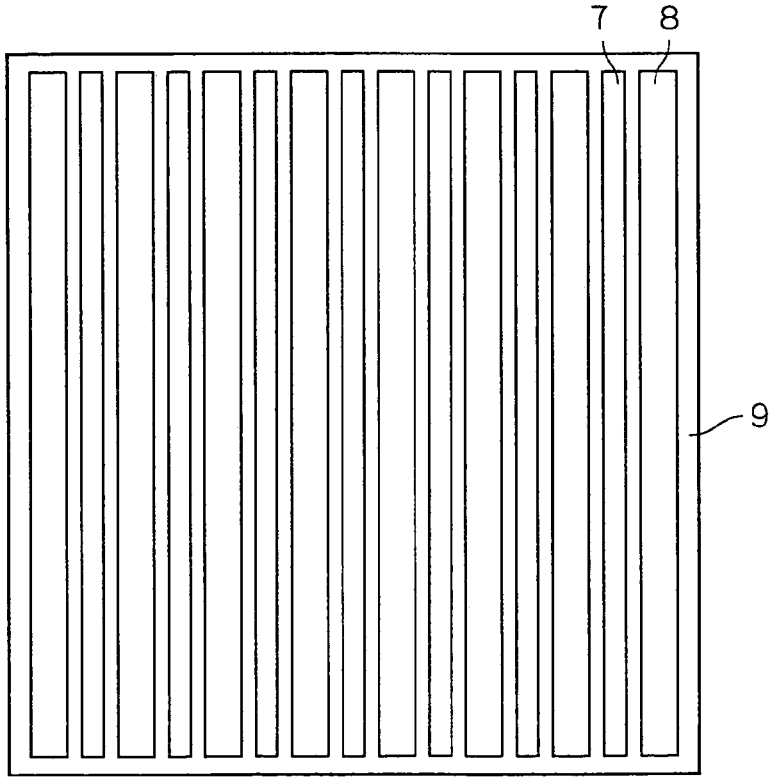
FIG. 3 is a plan view of a back substrate and cathodes according to the first preferred embodiment of the present invention.

On the other hand, a back substrate 9 according to the first preferred embodiment has a structure in which cathodes 7 are formed on the back substrate 9 so as to be opposite to the anodes 2, respectively, and barriers 8 are formed adjacent to the cathodes 7, respectively, on the back substrate 9. According to the first preferred embodiment, lines of the cathodes 7 and lines of the barriers 8 are arranged in stripes. The lines of the cathodes 7, each of which is 100 μm wide, are arranged so as to have a pitch of 200 μm. FIG. 3 is a plan view of the cathodes 7 and the barriers 8 on the back substrate 9. It is noted that the cathodes 7 are formed by depositing cold cathode materials on negative electrodes arranged in stripes on the back substrate 9, respectively. The barriers 8 are formed in stripes by a screen printing process or a blasting process using glass frit.

Figure 4:
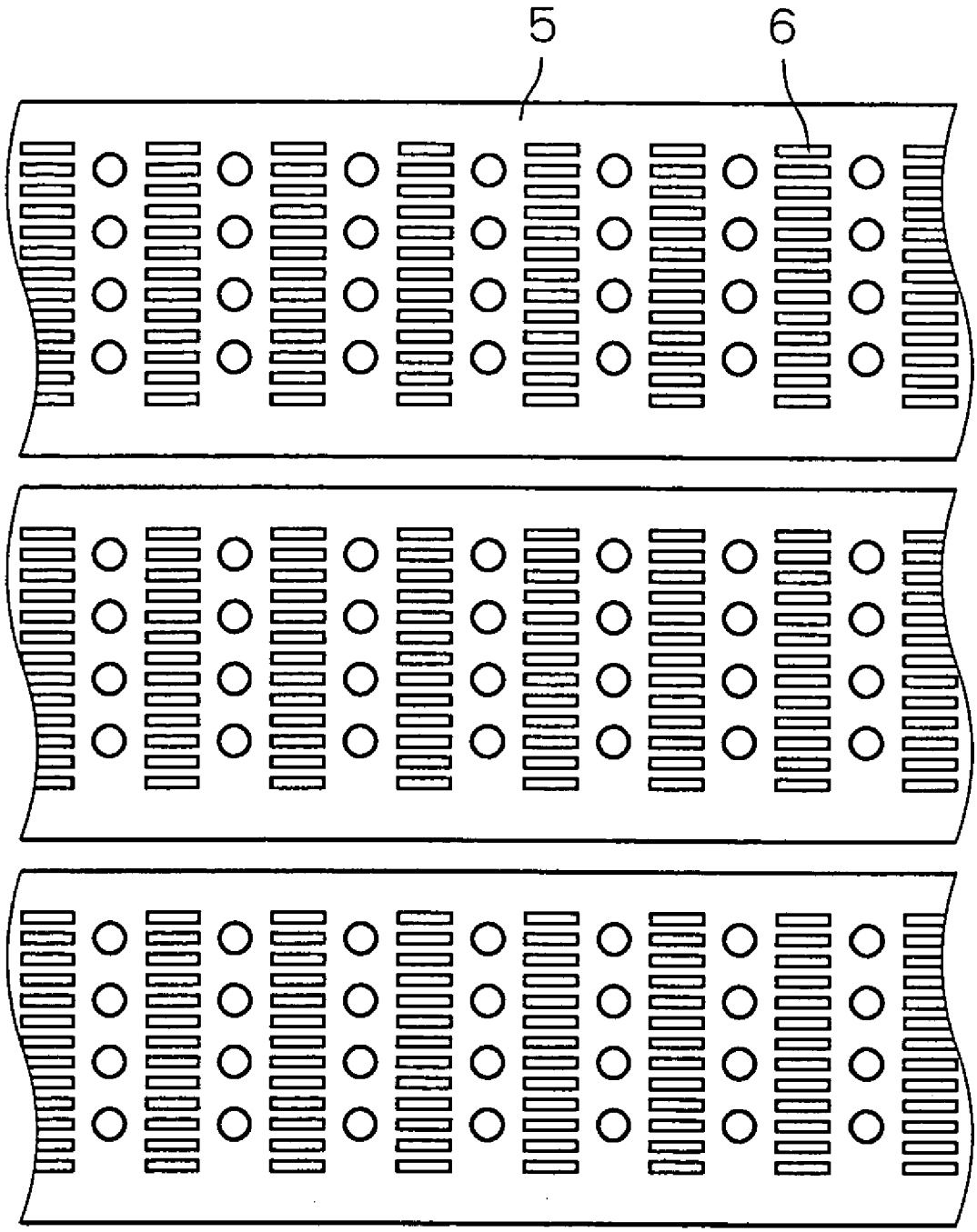
FIG. 4 is a plan view of extraction electrodes according to the first preferred embodiment of the present invention.

Further, extraction electrodes 5 arranged in stripes are provided over the back substrate 9 on which the cathodes 7 are formed, so as to be orthogonal to the stripes of the cathodes 7. The extraction electrodes 5 are provided with electron passage windows 6, and the extraction electrodes 5 are disposed such that the electron passage windows 6 are located on the cathodes 7. The extraction electrodes 5 are attached to, and supported by, the barriers 8 via glass frit. FIG. 4 is an enlarged plan view of the extraction electrodes 5. FIG. 4 illustrates three lines of the extraction electrodes 5. In each of the extraction electrodes 5, more than one electron passage window 6 is provided at each position for one pixel. One pixel includes approximately 10 electron passage windows 6. The electron passage windows 6, each with a 100 μm-long longer side and a 20 μm-long shorter side, are arranged so as to have a pitch of 60 μm. Moreover, circular apertures provided in the vicinity of the electron passage windows 6 of the extraction electrodes are used for attaching the extraction electrodes 5 to the barriers 8 so that the extraction electrodes 5 are supported by the barriers 8, via glass frit.

Figure 5:
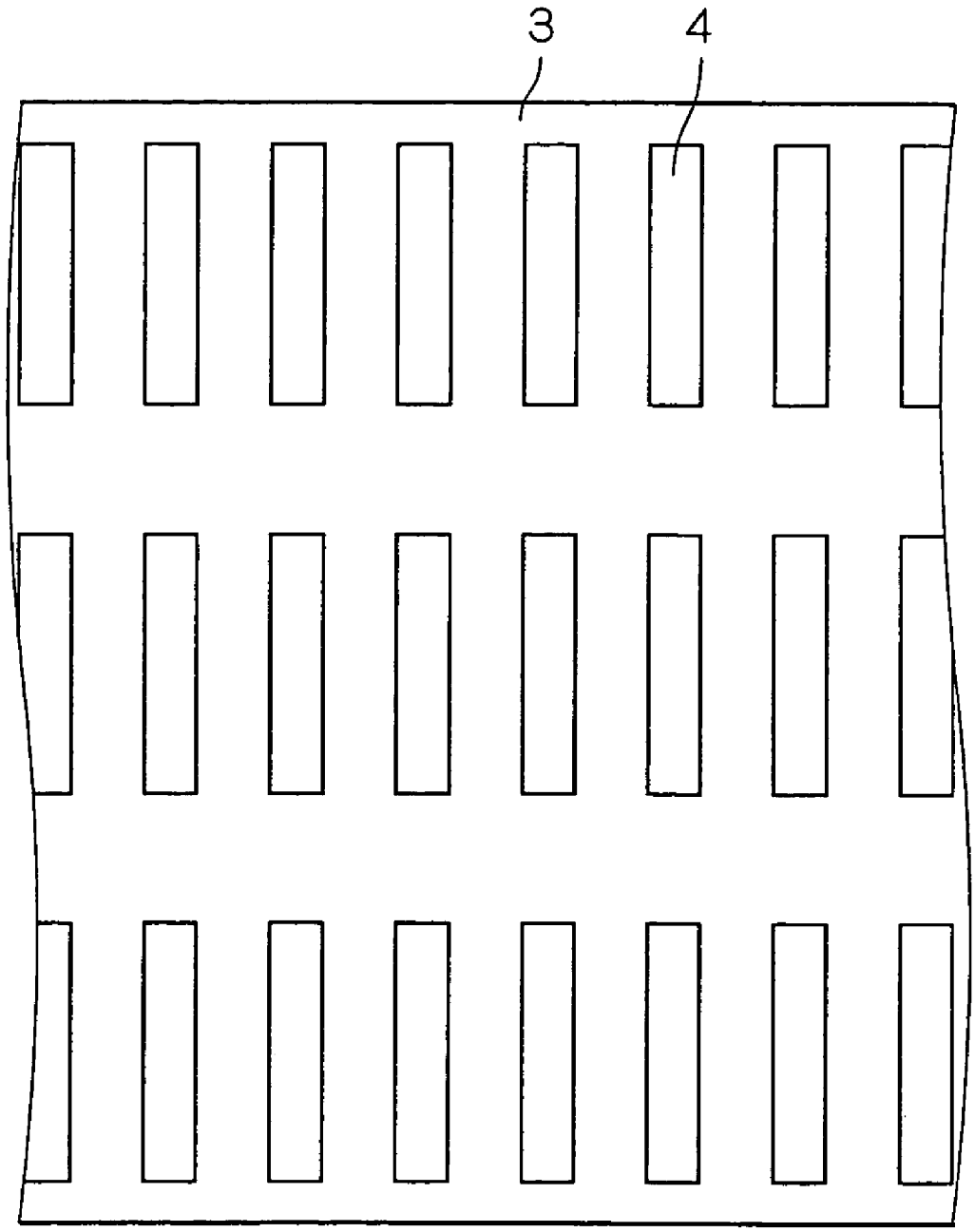
FIG. 5 is a plan view of a focus electrode according to the first preferred embodiment of the present invention.

The structure of the back substrate 9 according to the first preferred embodiment further includes a focus electrode 3. The focus electrode 3 is formed of a single metal plate and provided over the back substrate 9 on which the extraction electrodes 5 and the cathodes 7 are formed. Also, the focus electrode 3 is provided with electron passage windows 4, and the focus electrode 3 is disposed such that the electron passage windows 4 are located on the cathodes 7 and the electron passage windows 6 of the extraction electrodes. The focus electrode 3 is attached to, and supported by, the extraction electrodes 5, via an insulating material, with a predetermined distance being kept therebetween. FIG. 5 is an enlarged plan view of the focus electrode. The focus electrode 3 is formed of a single plate electrode having the substantially same size as the back substrate. The electron passage windows 4, each with a 500 μm-long longer side and a 100 μm-long shorter side, are arranged such that a grid is formed and each of the electron passage windows 4 contributes to formation of one pixel. Moreover, the focus electrode 3 has a plate thickness of 100 μm.

The cold cathode display device according to the first preferred embodiment has a structure in which the face substrate 1 with the foregoing structure and the back substrate 9 with the foregoing structure are disposed so as to allow the anodes 2 and the cathodes 7 to be opposite to each other, and respective peripheries of the face substrate 1 and the back substrate 9 are attached to, and supported by, each other via a spacer so that a predetermined distance can be kept therebetween. Additionally, another spacer is optionally provided inside the device in order to keep the predetermined distance between the face substrate 1 and the back substrate 9. To drive the cold cathode display device requires that a potential be externally supplied to electrodes such as the focus electrode 3 and the extraction electrodes 5. For this reason, those electrodes are connected to external electrodes as needed. However, FIG. 1 does not illustrate connection between those electrodes and external electrodes.

It is noted that values noted above for parameters such as dimensions of the windows and the plate thickness are provided for illustrative purposes, and can be arbitrarily determined depending on a specification of an individual cold cathode display device. Further, though the phosphors provided on the anodes 2 and the cathodes 7 are arranged in stripes according to the first preferred embodiment, such arrangement is a mere example. The phosphors provided on the anodes 2 and the cathodes 7 may alternatively be arranged in a matrix.

Figure 6:
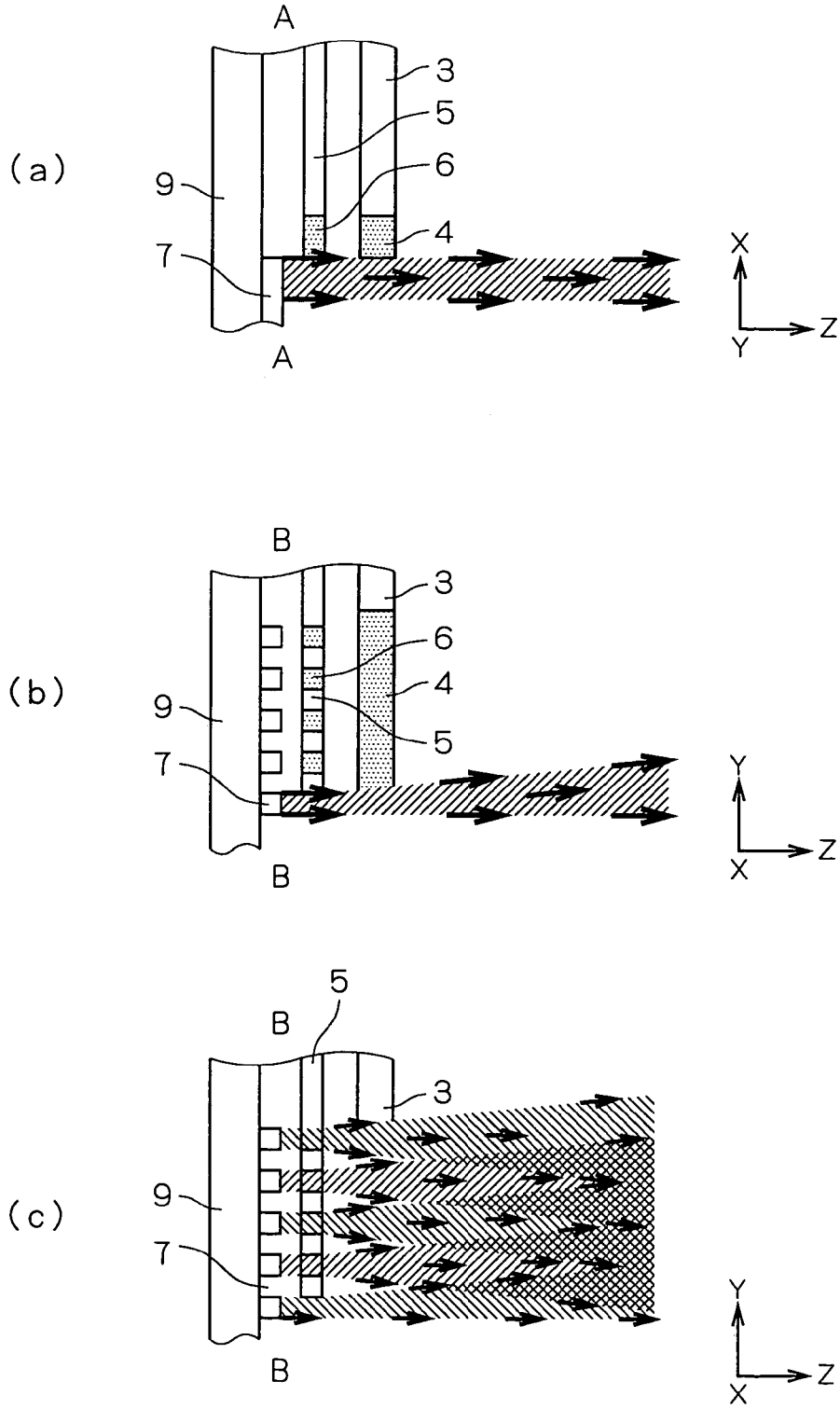
FIGS. 6(*a*)–6(*c*) are sectional views showing electron beam paths according to the first preferred embodiment of the present invention.

Next, operations of the focus electrode according to the first preferred embodiment will be explained. FIGS. 6(*a*)–6(*c*) show paths of electrons (which will hereinafter be also referred to as an "electron beam path(s)") emitted from the cathodes 7 in sections A—A and B—B of FIG. 1. In FIGS. 6(*a*)–6(*c*), arrows extending from the cathodes 7 indicate flow of electrons, and shaded portions indicate divergence of electrons. Further, it will be assumed that a direction orthogonal to the line of each of the cathodes 7 is an X direction, a direction parallel to the line of each of the cathodes 7 is a Y direction, and a direction from the cathodes 7 to the anodes 2 is a Z direction.

First, description will be made about an electron beam path in the section A—A parallel to the X direction (FIG. 6(*a*)). Electrons (electron beam) emitted in the Z direction from one of the cathodes 7 are attracted by one of the extraction electrodes 5. The longer side of each of the electron passage windows 6 of the extraction electrode extends along the X direction, and the extraction electrode 5 is located distantly from the electron beam path. Accordingly, the electron beam path goes through one of the electron passage windows 6 of the extraction electrode, with a force in the X direction being not substantially exerted thereon.

After the electrons pass the extraction electrode 5, the electrons are moderately accelerated by a potential difference between the extraction electrode 5 and the focus electrode 3. Also, as the focus electrode 3 causes a force in the X direction to be exerted on the electron beam path, the electron beam path expands. However, by reducing a distance between the extraction electrode 5 and the focus electrode 3, the expansion of the electron beam path is suppressed, to prevent the electrons from colliding with the focus electrode 3. Also, the shorter side of each of the electron passage windows 4 of the focus electrode 3 extends along the X direction, and the focus electrode 3 is located in the vicinity of the electron beam path. A region in the vicinity of the focus electrode 3 is affected by an electric field from the anodes 2, so that a force in a direction which causes the electron beam path to converge is exerted on the electron beam path. Therefore, the electron beam path in the section A—A parallel to the X direction gradually converges and is focused onto a surface of one of the anodes by the focus electrode 3.

Next, description will be made about an electron beam path in the section B—B parallel to the Y direction (FIG. 6(*b*)). Electrons (electron beam) emitted in the Z direction from one of the cathodes 7 are attracted by one of the extraction electrodes 5. The shorter side of each of the electron passage windows 6 of the extraction electrode extends along the Y direction, and the extraction electrode 5 is located in the vicinity of the electron beam path. Accordingly, a force in the Y direction is exerted on the electron beam path, and the electron beam path is attracted by the extraction electrode 5 more strongly as it approaches the extraction electrode 5. FIG. 6(*b*) illustrates a manner in which the electron beam path in the section B—B parallel to the Y direction expands after it goes through the extraction electrode 5.

After the electrons pass the extraction electrode 5, the electrons are moderately accelerated by a potential difference between the extraction electrode 5 and the focus electrode 3. Also, as the focus electrode 3 causes a force in the Y direction to be exerted on the electron beam path, the electron beam path expands. Further, the longer side of each of the electron passage windows 4 of the focus electrode 3 extends along the Y direction, and the focus electrode 3 is not present in the vicinity of the electron beam path. Accordingly, a force which is generated under influence of an electric field from one of the anodes 2 and causes the electron beam path to converge in the vicinity of the focus electrode 3 is not substantially exerted on the electron beam path. Therefore, the electron beam path in the section B—B parallel to the Y direction gradually expands to be focused onto the surface of the anode without converging.

Though FIG. 6(*b*) illustrates the electron beam path which comes from one of the electron passage windows 6 of the extraction electrode, which window is included in one pixel, more than one electron passage window 6 of the extraction electrode 5 is included in one pixel. As such, electron beam paths as illustrated in FIG. 6(*c*) are obtained per pixel. Thus, the provision of the focus electrode 3 as in the first preferred embodiment causes the electron beam path to converge in the X direction while expanding in the Y direction. It is noted that the electron beam paths illustrated in FIG. 6 are obtained in a case where a potential difference of 80V is applied between the extraction electrode 5 (□10V) and the cathode 7 (□90V) and a potential difference of 200V is applied between the extraction electrode 5 and the focus electrode 3.

Figure 7:
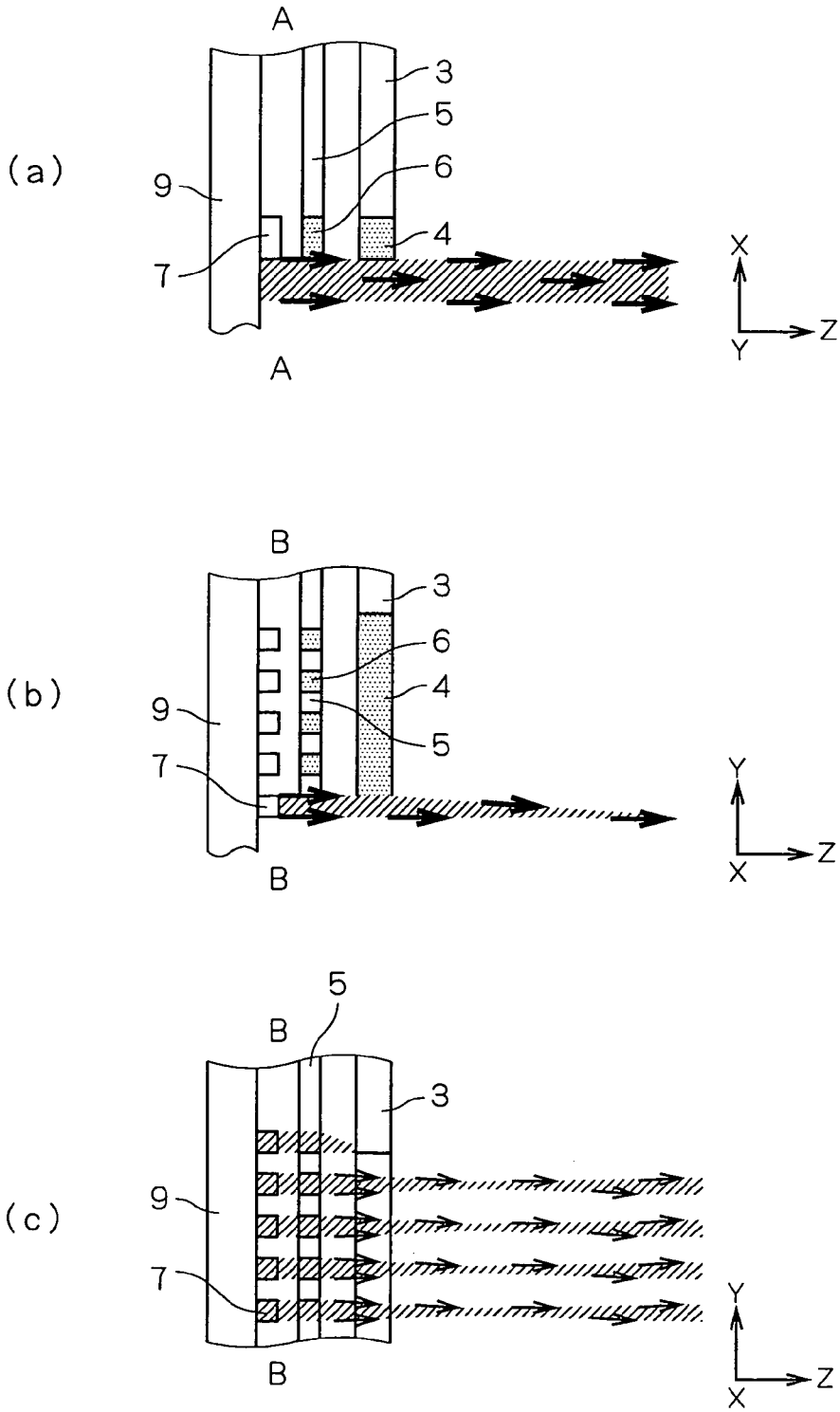
FIGS. 7(*a*)–7(*c*) are sectional views showing electron beam paths according the first preferred embodiment of the present invention.

Next, FIGS. 7(*a*)–7(*c*) show electron beam paths obtained in a case where a potential difference of 20V is applied between one of the extraction electrodes 5 (−10V) and one of the cathodes 7 (−30V) and a potential difference of 200V is applied between one of the extraction electrodes 5 and the focus electrode 3. In FIGS. 7(*a*)–7(*c*), arrows extending from the cathodes 7 indicate flow of electrons, and shaded portions indicate divergence of electrons. FIG. 7(*a*) illustrates an electron beam path in the section A—A parallel to the X direction. This electron beam path gradually converges and is focused onto the surface of one of the anodes by the focus electrode 3 in the same manner as illustrated in FIG. 6(*a*). FIG. 7(*b*) illustrates an electron beam path in the section B—B parallel to the Y direction, which comes from one of the electron passage windows 6 of the extraction electrodes, and FIG. 7(*c*) illustrates electron beam paths in the section B—B parallel to the Y direction obtained per pixel. In the case discussed herein, as a potential difference between the extraction electrode 5 and the cathode 7 is small, a force in the Y direction is weak, so that the electron beam paths are focused onto the surface of the anodes without expanding.

Figure 8:
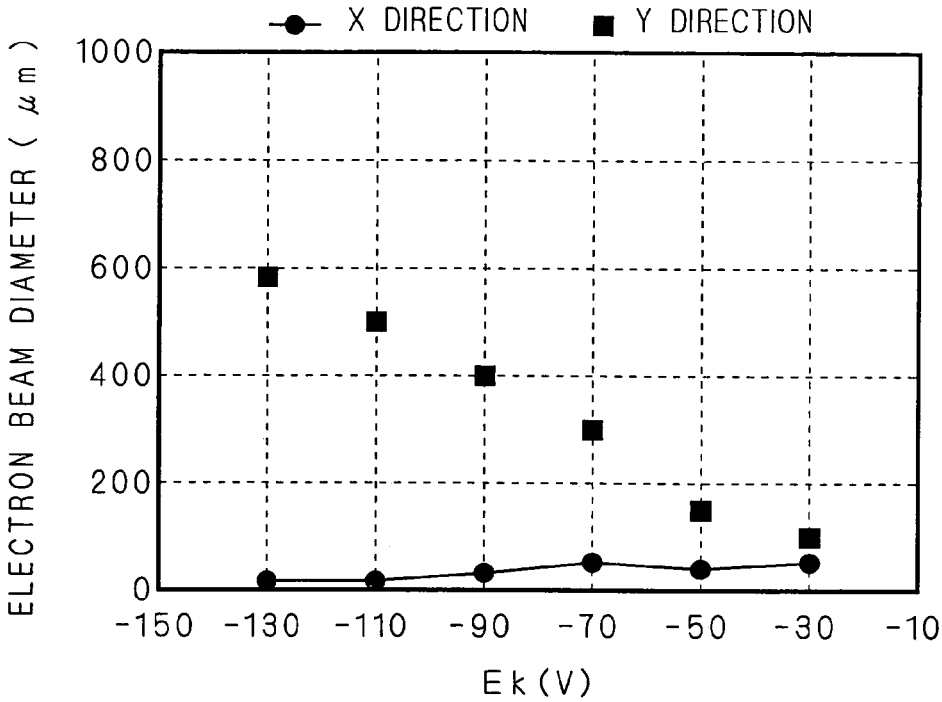
FIG. 8 is a view for showing a relationship between a potential difference between the extraction electrode and the cathode and an electron beam diameter according to the first preferred embodiment of the present invention.

Variation in electron beam diameter on the surface of one of the anodes in accordance with variation in a potential difference between one of the extraction electrodes 5 and one of the cathodes 7 as described above is shown in FIG. 8. FIG. 8 is resulted from varying only a voltage (Ek) on the cathode 7 while fixing a voltage on the extraction electrode 5 to −10V. As appreciated from FIG. 8, variation in the voltage (Ek) on the cathode 7 brings no significant variation in a diameter of an electron beam in the X direction. On the other hand, it is appreciated from FIG. 8 that a diameter of an electron beam in the Y direction increases as the voltage (Ek) on the cathode 7 decreases. The diameter of the electron beam in the X direction is not affected by variation in the potential difference between the extraction electrode 5 and the cathode 7, and the diameter of the electron beam in the Y direction increases in accordance with increase in the potential difference between the extraction electrode 5 and the cathode 7. It is noted that when the potential difference between the extraction electrode 5 (−10V) and the cathode 7 (Ek=−90V) is 80V, the diameter of the electron beam in the X direction is narrowed to 20 μm and the diameter of the electron beam in the Y direction is increased to 400 μm.

Figure 9:
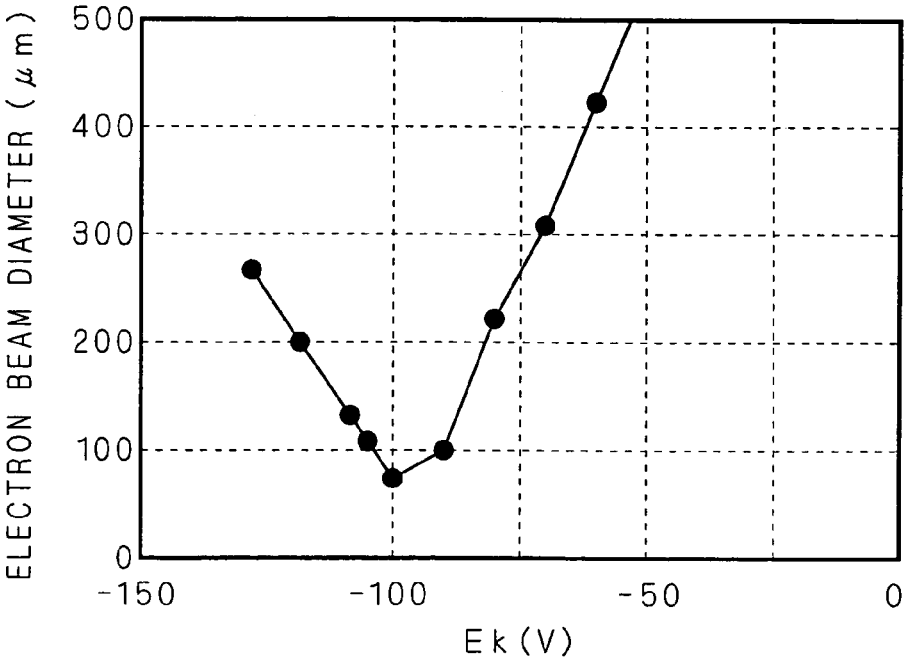
FIG. 9 is a view for showing a relationship between a potential difference between an extraction electrode and a cathode and an electron beam diameter in a cold cathode display device which does not include a focus electrode.

FIG. 9 shows variation in an electron beam diameter on one of the anodes in accordance with variation in a potential difference between one of the extraction electrodes 5 and one of the cathodes 7, which is obtained in a case where the focus electrode 3 is not included. Also FIG. 9 is resulted from varying only the voltage (Ek) on the cathode 7 while fixing the voltage on the extraction electrode 5 to −10V. FIG. 9 shows that the electron beam diameter becomes smallest when the voltage (Ek) on the cathode 7 is −100V. Under this condition, an electron beam is brought into focus in the above described structure when the structure is recognized as a lens system. When the voltage (Ek) on the cathode 7 is changed from −100V, the electron beam goes out of focus to cause overconvergence or misconvergence, so that the electron beam diameter on the surface of the anode abruptly varies. As such, if the focus electrode 3 is not included, an electron beam diameter is considerably affected by a potential difference between the extraction electrode 5 and the cathode 7. It is noted that a diameter of an electron beam does not vary depending on whether the electron beam is in the X direction or the Y direction in the case where the focus electrode 3 is not included.

As is made clear from the foregoing, the provision of the focus electrode 3 in the cold cathode display device makes it possible to control an electron beam diameter on the surface of each of the anodes so as to be smaller than a size of each of the phosphors. Also, an electron beam diameter can be controlled independently of a potential difference between one of the extraction electrodes 5 and one of the cathodes 7. Accordingly, there is no need for limiting a distance between the anodes 2 and the extraction electrodes 5 in order to control an electron beam diameter, which allows the anodes 2 to be distant from the extraction electrodes enough to ensure a breakdown voltage.

Since a distance between the anodes and the extraction electrodes can be broad, also a distance between the cathodes and the anodes can be broad. This eliminates a need for configuring the cold cathode display device to have a ratio of approximately 1:1 between a size of a light emitting part of each of the cathodes and a size of the phosphor of each of the anodes. Even in a situation where a voltage on one of the extraction electrodes is varied in order to adjust a current value so that a degree of convergence in the vicinity of the extraction electrode is varied to further vary an electron beam diameter, possible influence by the variation in electron beam diameter is prevented from being exerted directly on light emission of the phosphors of the anodes, to suppress problematic variation in brightness among pixels.

Further, since a distance between the anodes and the extraction electrodes can be broad, a required level of an accuracy in assembling can be reduced. This relieves the problem of degradation in color purity due to a positional shift of an electron beam and resulting emission of mixed colors in which a phosphor adjacent to an intended phosphor emits light, which are caused by a low accuracy in assembling.

Moreover, the problem of degradation in image quality due to localization of an electron emitting region in the surface of each of the cathodes which causes a lighted pixel to be interspersed with light emitting points like dots is relieved by provision of the focus electrode 3 in the cold cathode display device. Specifically, when electrons are emitted from one localized electron emitting region, a corresponding electron beam path is caused to expand in the Y direction by the focus electrode 3. As a result of this expansion of the electron beam path, the electron beam path and another electron beam path coming from another localized electron emitting region overlap each other on the surface of one of the anodes, to cause the phosphor to emit light on the surface of the anode. Accordingly, dot-like light emission in a lighted pixel is made uniform, to relieve a problem of degradation of image quality.

The cold cathode display device according to the first preferred embodiment includes a pair of substrates, the face substrate 1 and the back substrate 9 disposed opposite to each other, so as to form a space therebetween, which is evacuated. At least a display portion of the face substrate 1 serving as a display surface is transparent. The cold cathode display device according to the first preferred embodiment further includes: the anodes 2 which are disposed at predetermined positions on a side of the face substrate 1 on which the space is formed, and positive electrodes and phosphors formed on the positive electrodes; the cathodes 7 which are disposed at positions opposite to the anodes 2 on a side of the back substrate 9 on which the space is formed and which emit electrons upon application of a predetermined potential; the extraction electrodes 5 provided between the cathodes 7 and the anodes 2, for controlling the electrons emitted from the cathodes 7; and the focus electrode 3 which is provided between the anodes 2 and the extraction electrodes 5 and is provided with the electron passage windows 4 through which the electrons emitted from the cathodes 7 pass. The cold cathode display device according to the first preferred embodiment makes it possible: to dispose the anodes 2 at a sufficient distant from the extraction electrodes 5 to ensure a breakdown voltage; to sufficiently reduce an electron beam diameter relative to a size of each of the phosphors; and to prevent light emitting points from being interspersed like dots in each pixel to suppress degradation in image quality.

In the cold cathode display device according to the first preferred embodiment, the focus electrode 3 is made of a plate-shaped material, and the electron passage windows 4 are provided in the plate-shaped material so as to form a grid including elongate rectangles. The cold cathode display device according to the first preferred embodiment makes it possible: to dispose the anodes 2 at a sufficient distant from the extraction electrodes 5 to ensure a breakdown voltage; to sufficiently reduce an electron beam diameter relative to a size of each of the phosphors; and to prevent light emitting points from being interspersed like dots in each pixel to suppress degradation in image quality.

2. SECOND PREFERRED EMBODIMENT

Figure 10:
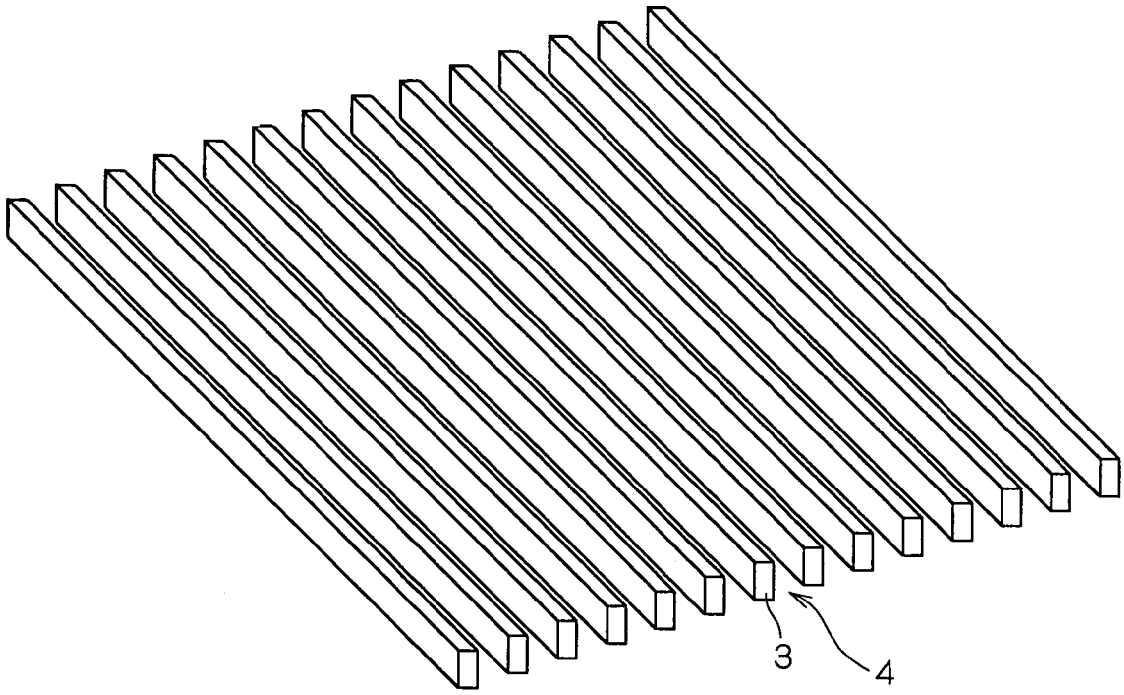
FIG. 10 is a perspective view of a configuration of a focus electrode according to a second preferred embodiment of the present invention.

FIG. 10 is a perspective view of a configuration of the focus electrode 3 according to a second preferred embodiment. According to the first preferred embodiment, the focus electrode 3 has a configuration in which the electron passage windows 4 are provided in a single plate electrode having the substantially same size as the back substrate 9 such that a grid can be formed in the electrode as illustrated in FIG. 1 or 5. Each of the electron passage windows 4 contributes to formation of one pixel in the first preferred embodiment.

The configuration of the focus electrode 3 according to the first preferred embodiment, however, requires that the electron passage windows 4 be aligned with the cathodes 7 and the electron passage windows 6 of the extraction electrodes because each of the electron passage windows 4 contributes to formation of one pixel. A level of an accuracy in this alignment should be high because of a small size of each of the electron passage windows 4 with a 500 μm-long longer side and a 100 μm-long shorter side. If the focus electrode 3 is misaligned, a sufficient electron beam does not reach each of the anodes 2, to reduce light emission of each of the phosphors resulting in degradation of image quality.

In view of the foregoing, the focus electrode 3 according to the second preferred embodiment has a configuration in which the electron passage windows 4 are arranged in stripes. In other words, the focus electrode 3 according to the second preferred embodiment is formed of a multiplicity of spaced parallel metal lines. As such, there is no portion of the focus electrode 3 in a direction orthogonal to the line of each of the cathodes 7. To employ such configuration with stripes for the focus electrode 3 eliminates a need for a high accuracy alignment in a direction parallel to the line of each of the cathodes 7, to facilitate manufacture.

It is noted that also the focus electrode 3 with the configuration according to the second preferred embodiment functions to narrow a diameter of an electron beam in the direction orthogonal to the line of each of the cathodes 7, (i.e., the X direction), and to increase a diameter of an electron beam in the direction parallel to the line of each of the cathodes 7 (i.e., Y direction), in the same manner as the focus electrode 3 according to the first preferred embodiment.

In a cold cathode display device according to the second preferred embodiment, the focus electrode 3 is made of a multiplicity of lines, and the multiplicity of lines are disposed so as to be parallel to, and spaced from, one another so that the electron passage windows 4 are arranged in stripes. The cold cathode display device according to the second preferred embodiment provides for reduction of a required level of an accuracy in alignment between the electron passage windows 4 of the focus electrode 3 and the electron passage windows, 6 of the extraction electrodes 5, or the like.

3. THIRD PREFERRED EMBODIMENT

Figure 11:
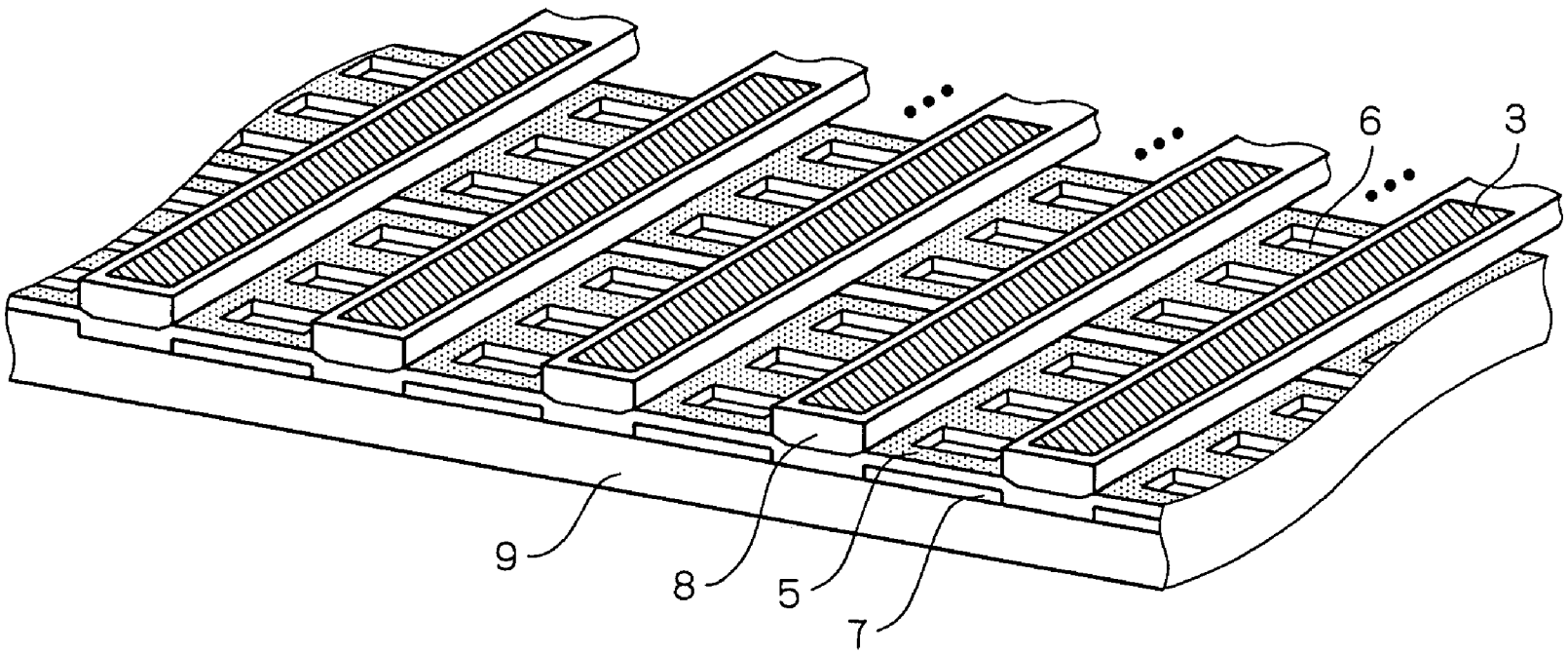
FIG. 11 is a perspective view of a structure on a back substrate according to a third preferred embodiment of the present invention.

FIG. 11 is a perspective view of a structure on a back substrate according to a third preferred embodiment. In the structure for a cold cathode display device illustrated in FIG. 11, the focus electrode 3 and the extraction electrodes 5 are formed on the back substrate 9 by a printing process.

Figure 12:
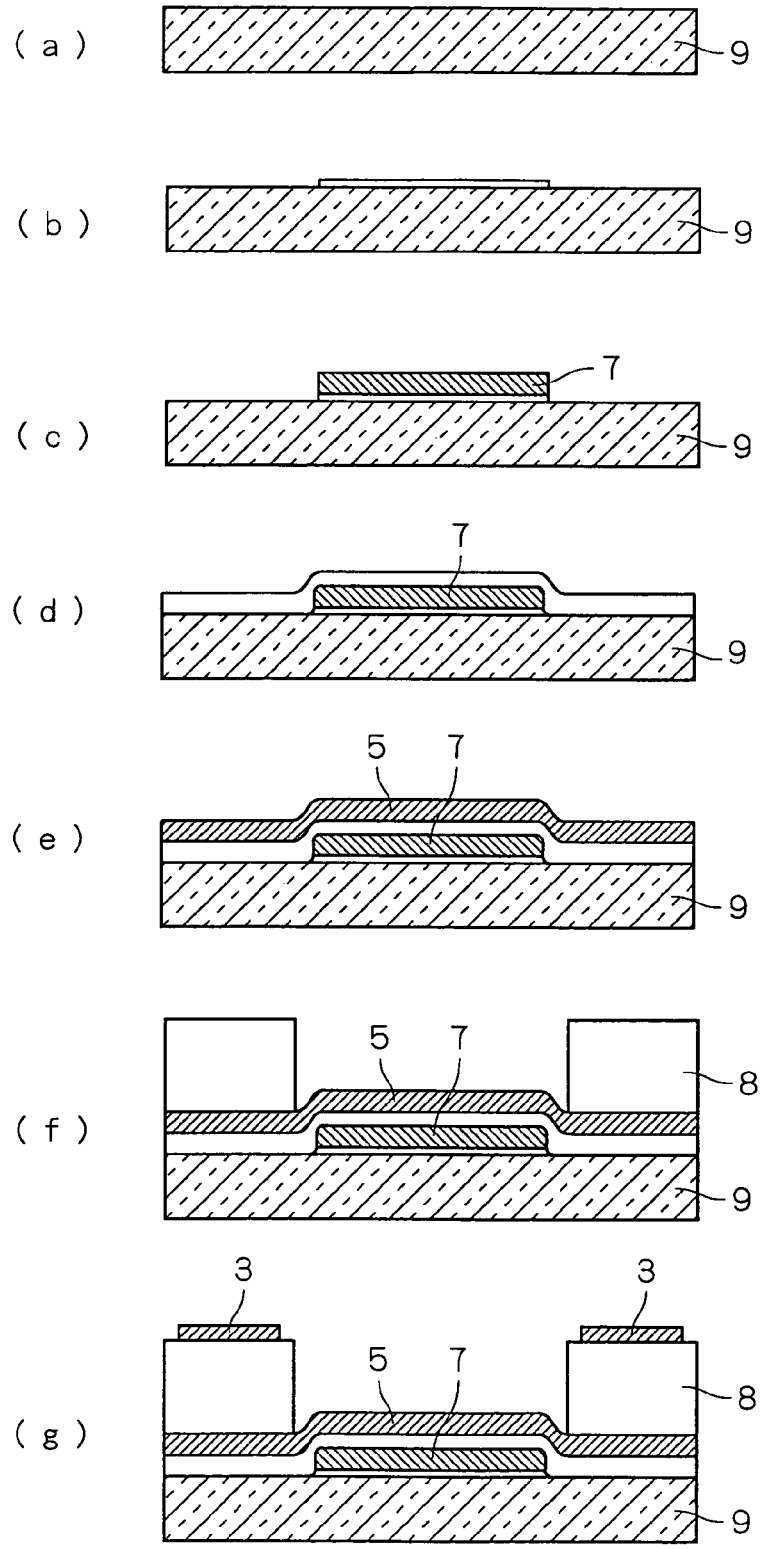
FIGS. 12(*a*)–12(*g*) illustrate processes in manufacturing a structure in the vicinity of a cathode according to the third preferred embodiment of the present invention.
Figure 13:
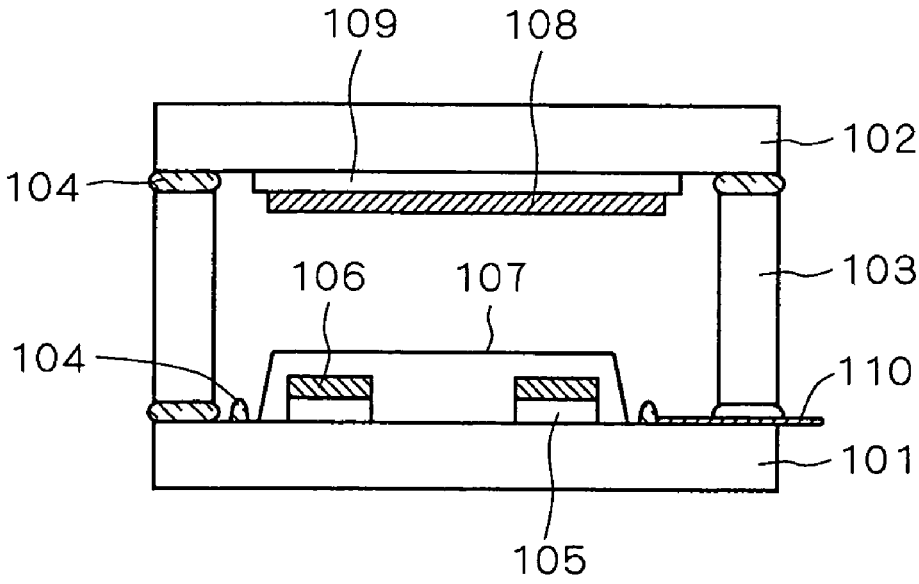
FIG. 13 is a plan view of a conventional cold cathode display device.

FIG. 12 illustrates processes for manufacturing a structure in the vicinity of one cathode according to the third preferred embodiment. First, after the back substrate 9 is cleaned (FIG. 12(*a*)), an electrode which is to serve as a negative electrode is formed on the back substrate 9 by evaporation (FIG. 12(*b*)), and a material for a cold cathode including a carbon nanotube or the like is printed to be coated on the electrode, then dried and polished, to form the cathode 7 (FIG. 12(*c*)). Further, an insulating film is coated on an entire surface of the back substrate 9 (FIG. 12(*d*)), and the extraction electrode 5 arranged orthogonally to the line of the cathode 7 is formed on the insulating film by a printing process (FIG. 12(*e*)). The extraction electrode 5 formed by a printing process includes windows through which electrons pass. Thereafter, glass paste is printed on portions of the extraction electrode 5 under which the cathode 7 is not present, then dried and polished, to form the barrier 8 parallel to the line of the cathode 7 (FIG. 12(*f*)). Lastly, the focus electrode 3 is formed on the barrier 8 by a printing process (FIG. 12(*g*)).

To employ a printing process in forming the focus electrode 3 and the extraction electrode 5 makes it possible to form the focus electrode 3 and the extraction electrode 5 with a high accuracy. Also, a further advantage of eliminating a need for a process of assembling the focus electrode 3 and the extraction electrode 5 is produced. Also the focus electrode 3 manufactured by such a manufacturing method as described above according to the third preferred embodiment functions to narrow a diameter of an electron beam in the direction orthogonal to the line of the cathode 7 (i.e., the X direction) and to increase a diameter of an electron beam in the direction parallel to the line of the cathode 7 (i.e., the Y direction) in the same manner as the focus electrode 3 according to the first preferred embodiment.

A method of manufacturing a cold cathode display device according to the third preferred embodiment includes a step of forming the extraction electrode 5 on the back substrate 9 by a printing process, and a step of forming the focus electrode 3 over the back substrate 9 by a printing process. The method of manufacturing a cold cathode display device according to the third preferred embodiment makes it possible to form the extraction electrode 5 and the focus electrode 3 with a higher accuracy, and eliminates a need for a process of assembling the extraction electrode 5 and the focus electrode 3.

Also, in the method of manufacturing a cold cathode display device according to the third preferred embodiment, the step of forming the focus electrode 3 over the back substrate 9 by a printing process includes forming the barrier 8 over the back substrate 9 and then forming the focus electrode 3 on the barrier 8 by a printing process. The method of manufacturing a cold cathode display device according to the third preferred embodiment makes it possible to form the extraction electrode 5 and the focus electrode 3 with a higher accuracy, and eliminates a need for a process of assembling the extraction electrode 5 and the focus electrode 3.

4. FOURTH PREFERRED EMBODIMENT

A cold cathode display device according to a fourth preferred embodiment is characterized by the window in the focus electrode. Description will be made with reference to FIG. 1 which is also referred to in the first preferred embodiment. The anodes 2 are formed in stripes on the face substrate 1. In FIG. 1, the anodes 2 are arranged along the Y direction. On the other hand, the cathodes 7 are formed at positions opposite to the anodes 2, respectively, on the back substrate 9, and the barriers 8 are formed adjacent to the cathodes 7, respectively, on the back substrate 9. In FIG. 1, both the cathodes 7 and the barriers 8 are arranged in stripes along the Y direction. For example, the lines of the cathodes 7, each of which is 100 μm wide, are arranged so as to have a pitch of 200 μm.

Further, the extraction electrodes 5 formed in stripes are provided over the back substrate 9 on which the cathodes 7 are formed, so as to be orthogonal to the stripes of the cathodes 7. The extraction electrodes 5 are provided with the electron passage windows 6, and the extraction electrodes 5 are disposed such that the electron passage windows 6 are located on the cathodes 7. The extraction electrodes 5 are attached to, and supported by, the barriers 8 via glass frit. More than one electron passage window 6 is provided at each position for one pixel. For example, one pixel includes approximately 10 electron passage windows 6. Each of the electron passage windows 6 is provided such that a longer side thereof and a shorter side thereof extend along the X direction and the Y direction, respectively. A length of the longer side is 100 μm, and a length of the shorter side is 20 μm, for example.

Moreover, the focus electrode 3 is formed over the back substrate 9 on which the extraction electrodes 5 and the cathodes 7 are formed. Also the focus electrode 3 is provided with the electron passage windows 4. Though FIG. 1 illustrates that each of the electron passage windows 4 is rectangular, each of the electron passage windows 4 may be non-circular. The electron passage windows 4 are provided so as to be located on the cathodes 7 and the electron passage windows 6 of the extraction electrodes 5, and to allow each longer side thereof to be parallel to a longer side of each of the anodes 2 (the Y direction). The longer side of each of the electron passage windows 4 is orthogonal to the longer side of each of the electron passage windows 6 of the extraction electrodes 5 (the X direction).

Because of such a structure in which more than one electron passage window 6 of the extraction electrodes 5 is provided so as to be matched with each of the electron passage windows 4 of the focus electrode 3, an electron having passed through one of the electron passage windows 6 and an electron having passed through another one of the electron passage windows 6 travel the same path when they pass through one of the electron passage windows 4. Accordingly, unevenness in distribution of electrons passing through the electron passage windows 6 can be eliminated when the electrons pass through the electron passage windows 4 so that evenness is achieved. Thus, it is possible to supply even distribution of electrons to the anodes 2.

Also, a configuration in which each longer side of the electron passage windows 6 extends along the X direction and each longer side of the electron passage windows 4 extends along the Y direction, allows for control of convergence of electrons in the X direction when the electrons pass through the electron passage windows 4. In a situation where a voltage applied between one of the extraction electrodes 5 and one of the cathodes 7 is controlled to vary a current value of electrons in order to allow a cold cathode display device to provide gradational display, converge of electrons in the X direction would not be affected by a change in voltage on the extraction electrode 5, in the foregoing configuration. Thus, it is possible to prevent electrons from being scattered too widely in the X direction before the electrons reach one of the anodes 2, to prevent a pixel different from an intended pixel from problematically emitting light.

In the cold cathode display device according to the fourth preferred embodiment, the focus electrode 3 is provided with the electron passage windows 4 each of which is rectangular or non-circular. A longer diameter or side of each of the electron passage windows 4 is parallel to a longer side of each of the phosphors formed on the anodes 2, and orthogonal to a longer diameter or side of each of the non-circular or rectangular electron passage windows 6 formed in the extraction electrodes 5. More than one electron passage window 6 is provided so as to be matched with each of the electron passage windows 4. In the cold cathode display device according to the fourth preferred embodiment, evenly distributed electrons can be supplied to the anodes 2. Further, no influence is exerted on convergence of electrons when the cold cathode display device provides gradational display.

5. FIFTH PREFERRED EMBODIMENT

According to a fifth preferred embodiment, a relationship between the window of the focus electrode 3 and a plate thickness of the focus electrode 3 is numerically limited. A structure according to the fifth preferred embodiment is substantially identical to that described in the first preferred embodiment and illustrated in FIG. 1.

The back substrate 9 according to the fifth preferred embodiment has a structure in which the cathodes 7 are formed on the back substrate 9 so as to be opposite to the anodes 2, respectively, and the barriers 8 are formed adjacent to the cathodes 7, respectively, on the back substrate 9. According to the fifth preferred embodiment, lines of the cathodes 7 and lines of the barriers 8 are arranged in stripes. The lines of the cathodes 7, each of which is 100 μm wide, are arranged so as to have a pitch of 200 μm. FIG. 3 is a plan view of the cathodes 7 and the barriers 8 on the back substrate 9. It is noted that the cathodes 7 are formed by depositing cold cathode materials on negative electrodes arranged in stripes on the back substrate 9, respectively. The barriers 8 are formed in stripes by a screen printing process or a blasting process using glass frit.

On the other hand, the anodes 2 are formed of R/G/B phosphors arranged in stripes, and sets each including one R phosphor, one G phosphor and one B phosphor are arranged so as to have a pitch of 0.6 mm. Further, black stripes are formed between the phosphors in order to improve contrast. Each of the phosphors is 100 μm wide, and an aluminum back is formed on each of the anodes 2 for the purposes of improving an efficiency in light emission and establishing electrical conduction. Moreover, a distance between the anodes 2 and the cathodes 7 is approximately 9 mm, and a voltage of 9 kV is applied between one of the anodes 2 and one of the cathodes 7.

Further, the extraction electrodes 5 arranged in stripes are provided over the back substrate 9 on which the cathodes 7 are formed, so as to be orthogonal to the stripes of the cathodes 7. The extraction electrodes 5 are provided with the electron passage windows 6, and the extraction electrodes 5 are disposed such that the electron passage windows 6 are located on the cathodes 7. The extraction electrodes 5 are attached to, and supported by, the barriers 8 via glass frit. In each of the extraction electrodes 5, more than one electron passage window 6 is provided at each position for one pixel. One pixel includes approximately 10 electron passage windows 6 of the extraction electrodes 5. The electron passage windows 6, each with a 100 μm-long longer side and a 20 μm-long shorter side, are arranged so as to have a pitch of 60 μm. In the fifth preferred embodiment, a width of each of the cathodes 7 serving as an electron emitting part is 100 μm.

Figure 14:
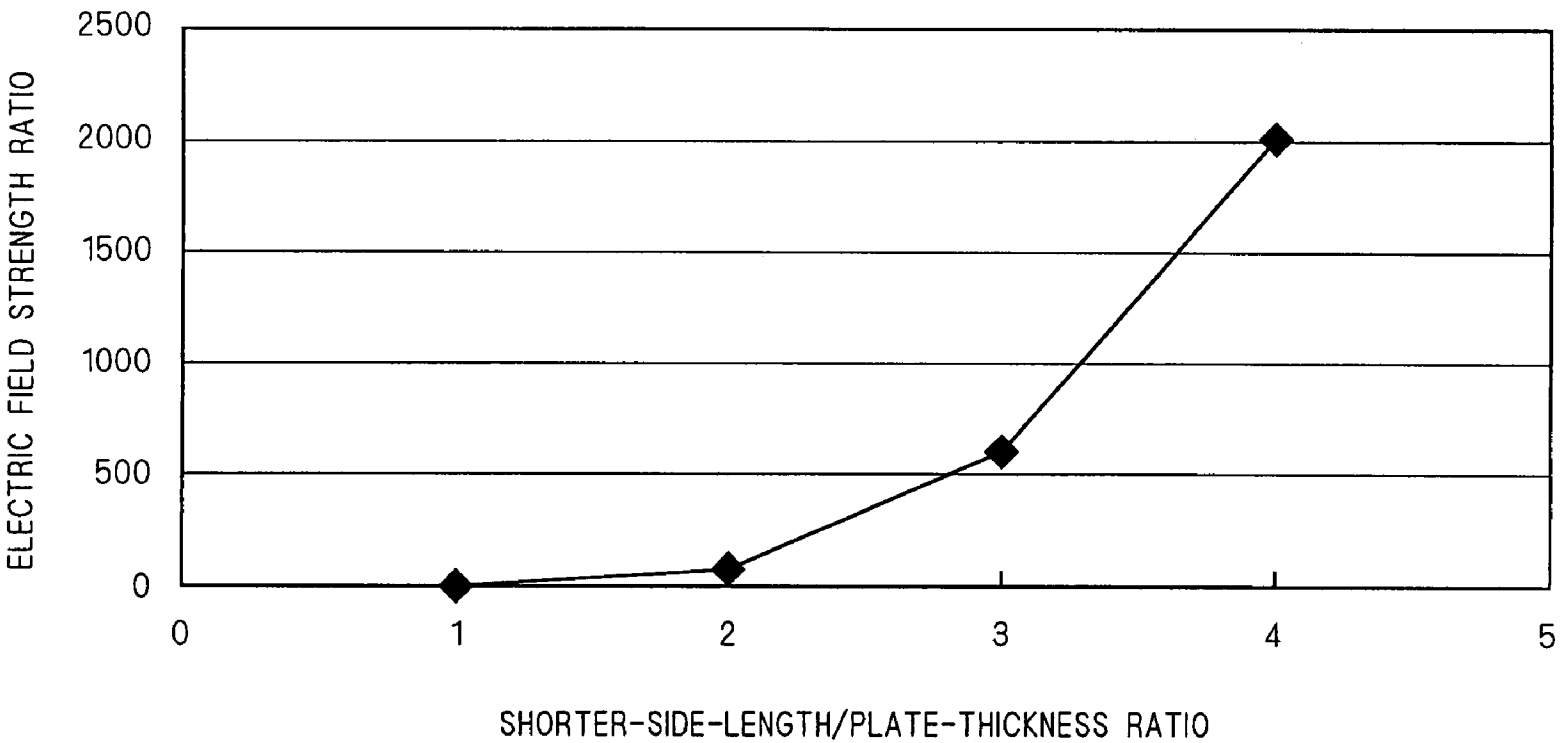
FIG. 14 is a view for showing a relationship between an electric field strength ratio and a shorter-side-length/plate-thickness ratio according to a fifth preferred embodiment of the present invention.

Then, the focus electrode 3 is formed over the back substrate 9 on which the extraction electrodes 5 and the cathodes 7 are formed. The focus electrode 3 is provided with the electron passage windows 4. FIG. 14 shows a relationship between a ratio of a strength of an electric field induced on one of the cathodes 7 to a voltage applied to one of the anodes 2 which induces the electric field, and a ratio of a length of a shorter side of each of the electron passage windows 4 to a plate thickness of the focus electrode 3. The ratio of a strength of an electric field induced on one of the cathodes 7 to a voltage applied to one of the anodes 2 which induces the electric field, will hereinafter be referred to as an "electric field strength ratio", and the ratio of a length of a shorter side of each of the electron passage windows 4 to a plate thickness of the focus electrode 3 will be hereinafter referred to as a "shorter-side-length/plate-thickness ratio", in the fifth preferred embodiment. As shown in FIG. 14, after the shorter-side-length/plate-thickness ratio exceeds 2, the electric field strength ratio increases greatly. Great increase of the electric field strength ratio means that influence of the voltage applied to the anode 2 which is exerted on the cathode 7 is increased. Relatively to this, influence of the voltage applied to the anode 2 which is exerted on the extraction electrodes 5 is decreased. That is, controllability that the extraction electrodes 5 has over electrons is degraded depending on a voltage applied to the anode 2.

To overcome this, according to the fifth preferred embodiment, the shorter-side-length/plate-thickness ratio is made smaller than 2 by utilizing the relationship between the electric field strength ratio and the shorter-side-length/plate-thickness ratio shown in FIG. 14. Specifically, the length of the shorter side of each of the electron passage windows 4 of the focus electrode 3 is determined to be smaller than twice the plate thickness of the focus electrode 3. It is noted that though the above description in the fifth preferred embodiment has been made assuming that each of the electron passage windows 4 is rectangular, each of the electron passage windows 4 may be non-circular. When each of the electron passage windows 4 is non-circular, the shorter-side-length/plate-thickness ratio should be replaced by a shorter-diameter/plate-thickness ratio in the above description.

In a cold cathode-display device according to the fifth preferred embodiment, a shorter diameter or a length of a shorter side of each of the electron passage windows 4 is smaller than twice the plate thickness of the focus electrode 3. In the cold cathode display device according to the fifth preferred embodiment, influence of a voltage applied to each of the anodes 2 which is exerted on the cathodes 7 does not become great, thereby preventing degradation of controllability of the extraction electrodes 5 over electrons.

6. SIXTH PREFERRED EMBODIMENT

According to a sixth preferred embodiment, a positional relationship between the focus electrode 3 and the cathodes 7 is numerically limited. Also a structure according to the sixth preferred embodiment is substantially identical to that described in the first preferred embodiment and illustrated in FIG. 1. The back substrate 9 has a structure in which the cathodes 7 are formed at positions opposite to the anodes 2, respectively, on the back substrate 9, and the barriers 8 are formed adjacent to the cathodes 7, respectively, on the back substrate 9. The cathodes 7 are formed by depositing cold cathode materials on negative electrodes arranged in stripes on the back substrate 9. The barriers 8 are formed in stripes by a screen printing process of a blasting process using glass frit.

On the other hand, the anodes 2 are formed of R/G/B phosphors arranged in stripes, and sets each including one R phosphor, one G phosphor and one B phosphor are arranged so as to have a pitch of 0.6 mm. Further, black stripes are formed between the phosphors in order to improve contrast. Each of the phosphors is 100 μm wide, and an aluminum back is formed on each of the anodes 2 for the purposes of improving an efficiency in light emission and establishing electrical conduction. Moreover, a distance between the anodes 2 and the cathodes 7 is approximately 9 mm, and a voltage of 9 kV is applied between one of the anodes 2 and one of the cathodes 7.

Figure 15:
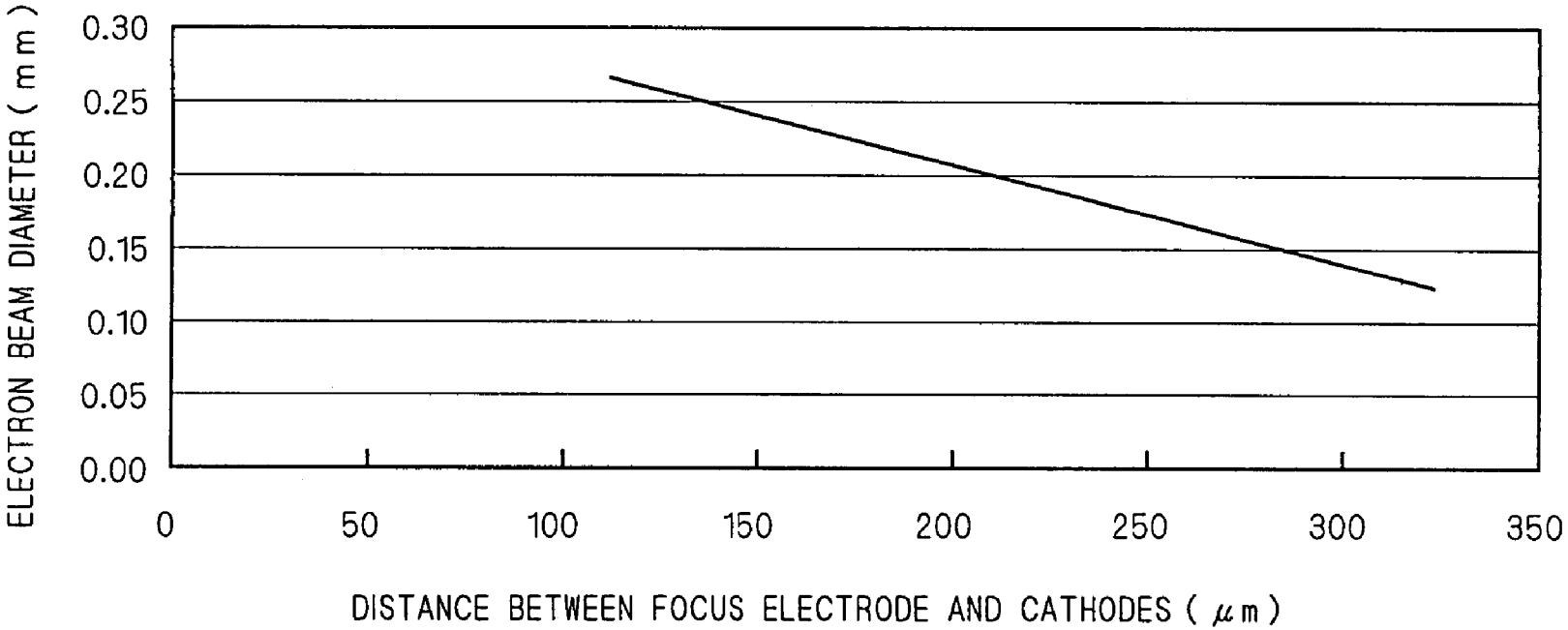
FIG. 15 is a view for showing a relationship between an electron beam diameter and a distance between a focus electrode and cathodes according to a sixth preferred embodiment of the present invention.

Further, the extraction electrodes 5 arranged in stripes are provided over the back substrate 9 on which the cathodes 7 are formed, so as to be orthogonal to the stripes of the cathodes 7. The extraction electrodes 5 are provided with the electron passage windows 6, and the extraction electrodes 5 are disposed such that the electron passage windows 6 are located on the cathodes 7. Then, the focus electrode 3 is formed over the back substrate 9 on which the extraction electrodes 5 and the cathodes 7 are formed. The focus electrode 3 is provided with the electron passage windows 4. FIG. 15 shows a relationship between a distance between the focus electrode 3 and the cathodes 7 and an electron beam diameter on one of the anodes 2. It is noted that the distance between the focus electrode 3 and the cathodes 7 is a minimum distance between the focus electrode 3 and one of the cathodes 7, more specifically, a distance between a bottom surface of the focus electrode 3 and a top surface of the one cathode 7.

Figure 16:
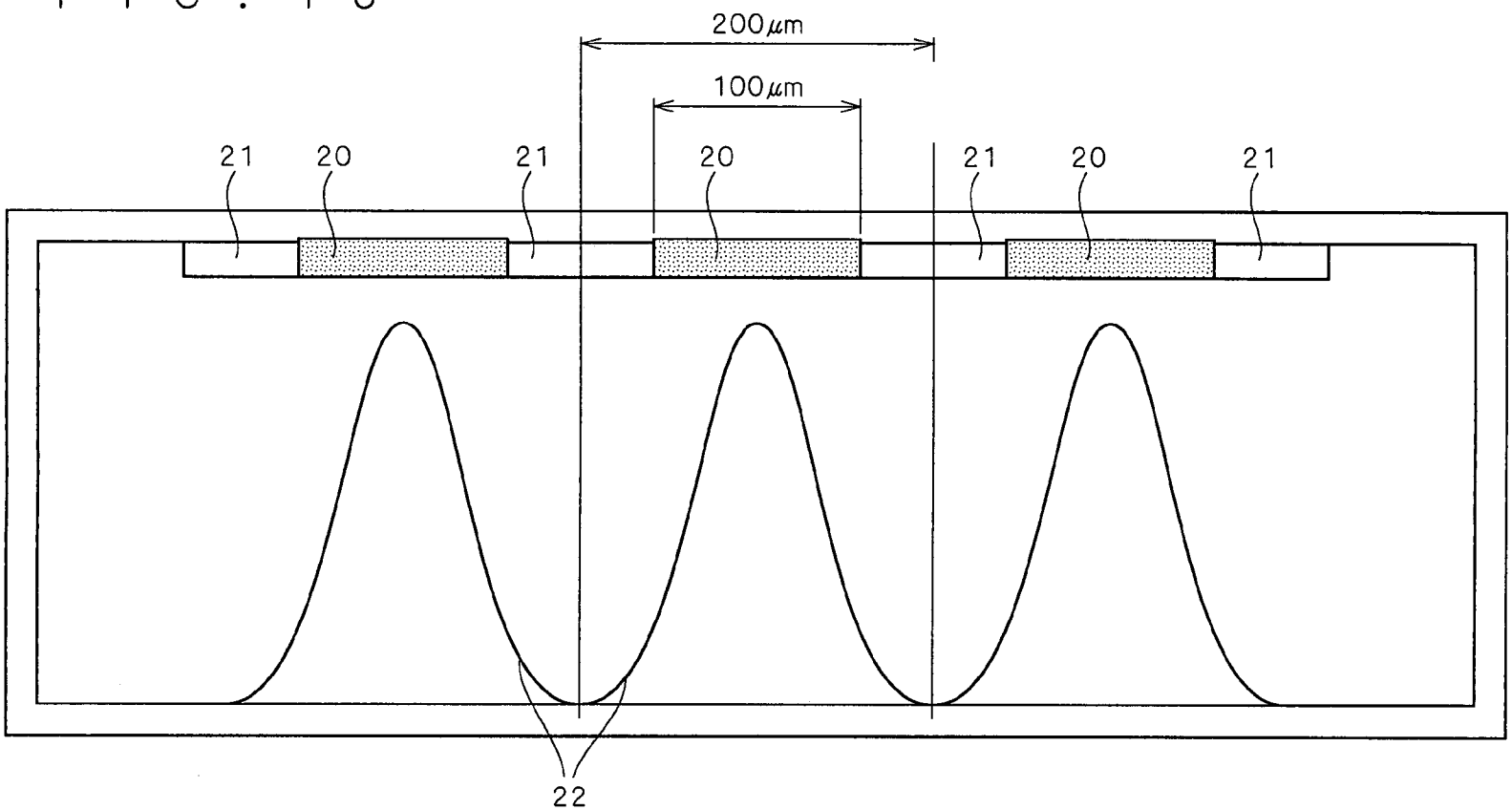
FIG. 16 is a schematic view for showing a relationship between an electron beam diameter and a phosphor according to the sixth preferred embodiment of the present invention.

FIG. 16 is a schematic view for showing a relationship between an electron beam diameter and a phosphor. Black stripes 21 are formed between R/G/B phosphors 20. A width of each of the phosphors 20 and the black stripes 21 is 100 μm. In FIG. 16, an electron beam distribution 22 is approximated as a normal distribution. In order to impart a high display quality to a cold cathode display device, it is necessary to prevent other phosphors than a predetermined phosphor from being excited because of the electron beam distribution 22. It is noted that the electron beam distribution 22 substantially corresponds to an electron beam diameter, and thus will hereinafter be referred to as an electron beam diameter. In order to prevent other phosphors than a predetermined phosphor from being exited, it is necessary to limit a maximum electron beam diameter to a size equal to a total size including a width of one of the phosphors and respective halves of two of the black stripes 21 each adjacent to the one of the phosphors. Specifically, in FIG. 16, an electron beam diameter should be 200 μm or smaller. As a result, the distance between the focus electrode 3 and the cathodes 7 should be 200 μm or larger, which is appreciated from FIG. 15.

The foregoing relationship indicates that an electrostatic lens is formed because of the distance between the focus electrode 3 and the cathodes 7. Accordingly, it can be interpreted that an image of electrons emitted from the cathodes 7 is formed on each of the anodes 2 using the focus electrode 3. In view of this, to formulate a model by representing the distance between the focus electrode 3 and the cathodes 7 by d, a distance between the anodes 2 and the cathodes 7 by D, a width of each of the cathodes 7 by w, a pitch of the R/G/B phosphors by W (0.2 mm in the sixth preferred embodiment), and a voltage on each of the anodes by Va (kV), results in establishment of a relationship of $F \times w \times ((D-d)/d) \times (9/Va)^{1/2} < W$. As d=200 μm, D=9000 μm, w=100 μm, W=200 μm, and Va=9 kV in the sixth preferred embodiment, F is smaller than 1/22. Accordingly, the distance d between the focus electrode 3 and the cathodes 7 should be determined so as to establish a relationship of $(D/d-1) \times w \times (9/Va)^{1/2}/W < 22$ It is noted that the distance between the anodes 2 and the cathode 7 is a minimum distance between one of the anodes 2 and one of the cathodes 7, more specifically, a distance between a bottom surface of the one anode 2 and a top surface of the one cathode 7.

In a cold cathode display device according to the sixth preferred embodiment, the distance d between the focus electrode 3 and the cathodes 7 is correlated with the distance D between the cathodes 7 and the anodes 2, the width w of each of the cathodes 7, the pitch W of the phosphors and the voltage Va on each of the anodes, such that the relationship of $(D/d-1) \times w \times (9/Va)^{1/2}/W < 22$ is satisfied. The cold cathode display device according to the sixth preferred embodiment prevents other phosphors than an intended phosphor from emitting light due to emission of electrons to the other phosphors. Thus, a cold cathode display device having a high display quality can be achieved.

7. SEVENTH PREFERRED EMBODIMENT

Figure 17:
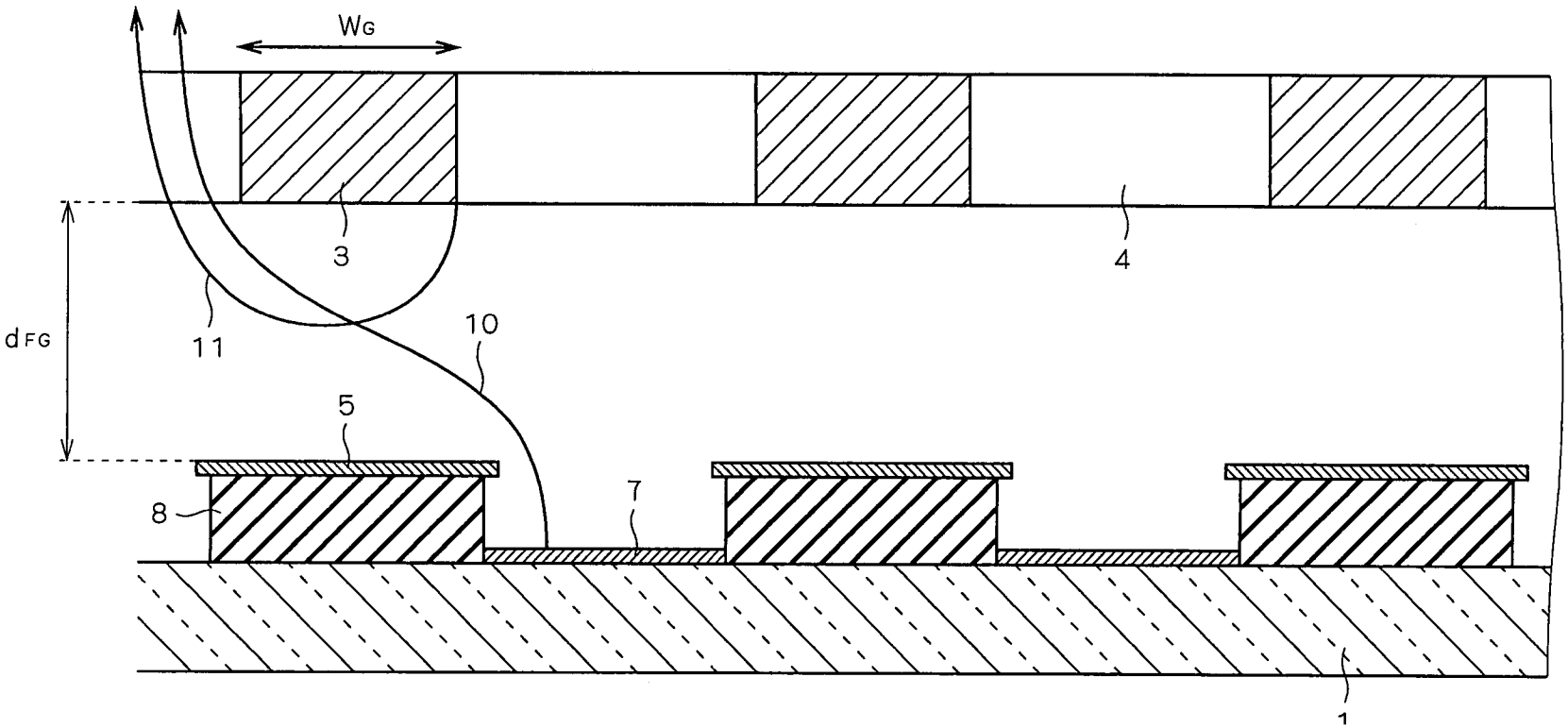
FIG. 17 is a sectional view of a cold cathode display device according to a seventh preferred embodiment of the present invention.

According to a seventh preferred embodiment, a relationship between a distance between the focus electrode 3 and the extraction electrodes 5 and an interval between the electron passage windows 4 are determined. It is noted that the distance between the focus electrode 3 and the extraction electrodes 5 is a minimum distance between the focus electrode 3 and one of the extraction electrodes 5, more specifically, a distance between a bottom surface of the focus electrode 3 and a top surface of the one extraction electrode 5. FIG. 17 is a sectional view of a cold cathode display device according to the seventh preferred embodiment, and more specifically, an enlarged sectional view of a region in the vicinity of the focus electrode 3 and the extraction electrodes 5 of the cold cathode display device. In FIG. 17, the cathodes 7 are formed on the substrate, and the barriers 8 are formed between the cathodes 7. The extraction electrodes 5 are provided on the barriers 8, and further, the focus electrode 3 is provided at a distance dFG from the extraction electrodes 5. The electron passage windows 6 of the extraction electrodes 5 and the electron passage windows 4 of the focus electrode 3 are formed on the cathodes 7 so that electrons emitted from the cathodes 7 can reach the anodes (not illustrated). FIG. 17 illustrates a first electron path 10 which electrons emitted from the cathodes 7 travel and a second electron path 11 which electrons scattered by the focus electrode 3 travel. Further, in FIG. 17, an interval between the electron passage windows 4 which are provided so as to form a grid in the focus electrode 3 is denoted by WG, and a distance between the focus electrode 3 and the extraction electrodes 5 is denoted by dFG.

Electrons attracted by the extraction electrodes 5 move toward the focus electrode 3. However, the electrons, which have just been emitted from the cathodes 7, have an extremely large divergence angle. For this reason, there may occur a situation in which an electron emitted from one of the cathodes 7 does not pass through one of the electron passage windows 4 immediately on the one cathode 7, but travels the first electron path 10 illustrated in FIG. 17, and then is emitted from another of the electron passage windows 4, which is located diagonally to the one cathode 7 from which the electron is emitted, to one of the anodes. Alternatively, there may occur another situation in which an electron emitted from one of the cathodes 7 is hit by the focus electrode 3, to be emitted to one of the anodes, having traveled the second electron path 11 as illustrated in FIG. 17. In either situation, a pixel different from a predetermined pixel is caused to emit light, which results in degradation of display quality of the cold cathode display device.

According to the seventh preferred embodiment, a relationship between the interval WG between the electron passage windows 4 and the distance dFG between the focus electrode 3 and the extraction electrodes 5 is adjusted in order to eliminate an electron passing through one of the electron passage windows 4 which is located diagonally to one of the cathodes 7 from which the electron is emitted, as described above. More specifically, a condition under which an electron with an initial energy emitted from one of the cathodes 7 should be attracted by the focus electrode 3 or one of the extraction electrodes 5 when the electron is located out of one of the electron passage windows 4 immediately on the one cathode 7 and is passing through a region between the interval WG between the electron passage windows 4 and the extraction electrode 5, is determined. By determining such condition, it is possible to eliminate an electron which causes a pixel different from a predetermined pixel to emit light to degrade display quality of the cold cathode display device. It is noted that the following discussion will be made assuming that a potential on one of the cathodes 7 is a reference value.

The condition under which an electron should be attracted by the focus electrode 3 or one of the extraction electrodes 5 before the electron passes through the interval WG between the electron passage windows 4 is expressed as WG>initial energy of the electron/abs(VF−VG)×dFG where VF represents a voltage on the focus electrode 3, and VG represents a voltage on the extraction electrode. It is additionally noted that abs(VF−VG) indicates an absolute value of (VF−VG). The initial energy is equal to the voltage VF on the focus electrode 3, provided that an electron emitted from an electron emitting material does not collide with any of the extraction electrodes. Accordingly, the condition under which an electron should be attracted by the focus electrode 3 or the extraction electrode 5 is expressed as WG>VF/abs(VF−VG)×dFG.

When the voltage VF on the focus electrode 3 is 200V, the voltage VG on the extraction electrodes 5 is 450V, the interval WG between the electron passage windows 4 is 200 μm, and the distance. dFG between the focus electrode 3 and the extraction electrodes 5 is 100 μm, for example, the right side of the foregoing expression is 200/250×100 μm=80 μm, and the left side is 200 μm. Thus, the foregoing condition is satisfied. Also, in actual experiments using the foregoing values, an electron is prevented from being emitted from one of the electron passage windows 4 located diagonally to one of the cathodes 7 from which the electron is emitted. When an electron is emitted from one of the extraction electrodes 5, an initial energy of the electron is 450V, so that the right side of the foregoing expression is 400/250×100 μm=160 μm and the left side is 200 μm. Thus, the foregoing condition is satisfied. Hence, a structure in which an electron is prevented from being emitted from one of the electron passage windows 4 located diagonally to one of the cathodes 7 from which the electron is emitted is provided.

Further, a length of a shorter side of each of the electron passage windows 4 is occasionally made smaller than a width of each of the phosphors in order to improve a focusing performance of an electron beam on a screen. In such a case, an electron is likely to collide with the focus electrode 3, which causes the electron hit by the focus electrode 3 to be emitted from one of the electron passage windows 4 located diagonally to one of the cathodes 7 from which the electron is emitted, to one of the anodes. For example, when a length of a shorter side of each of the electron passage windows 4 is 60 μm, the voltage VF on the focus electrode 3 is 200V, a sub-pixel pitch on the surface of each of the anodes is 0.2 mm, a width of each of the phosphors is 0.1 mm, the voltage VG on the extraction electrode 5 is 450V, the interval WG between the electron passage windows 4 is 140 μm, and the distance between the focus electrode 3 and the extraction electrodes 5 is 100 μm, the right side of the foregoing expression is 200/250×150 μm=120 μm and the left side is 200 μm. Thus, the foregoing condition is satisfied. Also, in actual experiments using the foregoing values, an electron is prevented from being emitted from one of the electron passage windows 4 located diagonally to one of the cathodes 7 from which the electron is emitted.

In the cold cathode display device according to the seventh preferred embodiment, the interval WG between adjacent ones of the electron passage windows 4 is correlated with the distance dFG between the focus electrode 3 and the extraction electrodes 5 and the voltages VF and VG on the focus electrode 3 and one of the extraction electrodes 5, respectively, which are set when a voltage on one of the cathodes 7 is a reference value, such that the relationship of WG>VF/abs(VF−VG)×dFG is satisfied. The cold cathode display device according to the seventh preferred embodiment provides for elimination of an electron which causes a pixel different from a predetermined pixel to emit light to degrade display quality of the cold cathode display device.

8. EIGHTH PREFERRED EMBODIMENT

According to an eighth preferred embodiment, a length of a longer side of each of the electron passage windows 6 and a width of each of the cathodes 7 as an electron emitting part are numerically limited in order to suppress divergence of electrons attracted by the extraction electrodes 5. A structure according to the eighth preferred embodiment is substantially identical to that described in the first preferred embodiment and illustrated in FIG. 1. The extraction electrodes 5 arranged in stripes are provided over the back substrate 9 on which the cathodes 7 are formed, so as to be orthogonal to the stripes of the cathodes 7. The extraction electrodes 5 are provided with the electron passage windows 6, and the extraction electrodes 5 are disposed such that the electron passage windows 6 are located on the cathodes 7. The extraction electrodes 5 are attached to, and supported by, the barriers 8 via glass frit. In each of the extraction electrodes 5, more than one electron passage window 6 of the extraction electrodes is provided at each position for one pixel. One pixel includes approximately 10 electron passage windows 6 of the extraction electrodes. Further, the electron passage windows 6 are arranged in a line parallel to a direction in which each of the cathodes 7 extends (i.e., the Y direction), at each of portions (corresponding to a pixel) at which the cathodes 7 and the extraction electrodes 5 intersect each other. The electron passage windows 6, each with a 60 μm-long longer side and a 10 μm-long shorter side, are arranged so as to have a pitch of 20 μm.

Figure 18:
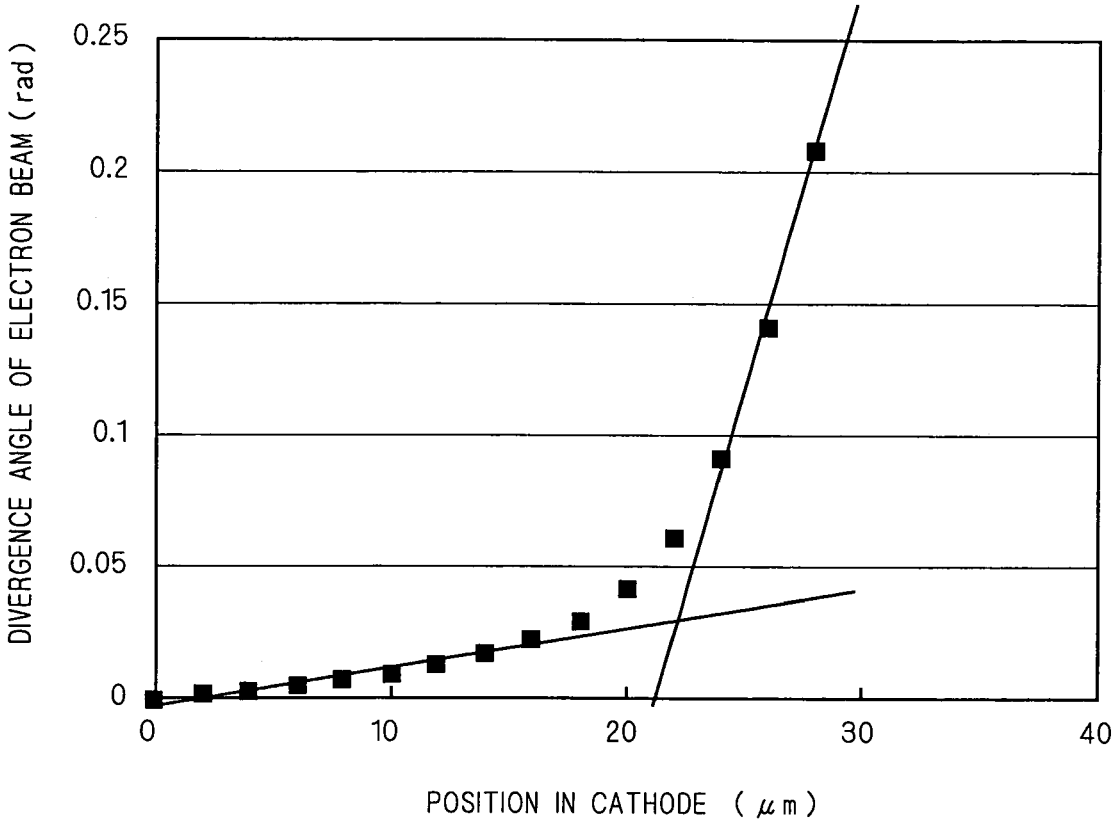
FIG. 18 is a view for showing a relationship between a position in a cathode and a divergence angle of an electron beam according to an eighth preferred embodiment of the present invention.

Then, a distance between the extraction electrodes 5 and the cathodes 7 is set to 10 μm. It is noted that the distance between the extraction electrodes 5 and the cathodes 7 is a minimum distance between one of the extraction electrodes 5 and one of the cathodes 7, more specifically, a distance between a bottom surface of the one extraction electrode 5 and a top surface of the one cathode 7. FIG. 18 shows a relationship between divergence of electrons which are passing through one of the electron passage windows 6 and a position in the cathode 7. It is noted that the position in the cathode 7 represents a distance in a width direction (i.e., the X direction) from a center of each of the cathodes 7. That is, a position closer to an edge of the cathode 7 has a larger value of the position in the cathode 7. As shown in FIG. 18, the divergence of electrons which are passing through the electron passage window 6 becomes great abruptly when the position in the cathode 7 exceeds 20 μm. In FIG. 18, the divergence of electrons which are passing through the electron passage window 6 is represented in terms of a divergence angle of an electron beam (rad). It is appreciated from FIG. 18 that when the width of the cathode 7 is 40 μm, a divergence angle of an electron beam is sufficiently reduced.

In view of this, from the length of 60 μm of the longer side of each of the electron passage windows 6 and the distance of 10 μm between the extraction electrodes 5 and the cathodes 7, an expression for the width of each of the cathodes 7 can be derived as (L−2G) where L represents a length of the longer side of each of the electron passage windows 6 and G represents the distance between the extraction electrodes 5 and the cathodes 7. While the distance G between the extraction electrodes 5 and the cathodes 7 is set to 10 μm in FIG. 18, the expression for the width of each of the cathodes 7 can be derived as (L−2G) even when the value for G is varied. Accordingly, by setting the width of each of the cathodes 7 to (L−2G) where L represents a length of the longer side of each of the electron passage windows 6 and G represents the distance between the extraction electrodes 5 and the cathodes 7, it is possible to obtain a cold cathode display device which provides for suppression of divergence of electrons when they pass through the electron passage windows 6.

A cold cathode display device according to the eighth preferred embodiment, each of the extraction electrodes 5 is provided with more than one electron passage window 6 which is non-circular or rectangular, at each position therein for one pixel. The electron passage windows 6 are arranged in a line parallel to a direction in which each of the cathodes 7 extends, at each of portions at which the extraction electrodes 5 and the cathodes 7 intersect each other. In the cold cathode display device according to the eighth preferred embodiment, an aperture ratio of each of the electron passage windows 6 can be increased, to produce an advantage of enhancing an efficiency in electron emission as compared to a device in which the electron passage windows 6 are arranged in plural lines at each of portions at which the extraction electrodes 5 and the cathodes 7 intersect each other.

Also, in the cold cathode display device according to the eighth preferred embodiment, the width of each of the cathodes 7 is equal to a length obtained by subtracting twice the distance between the extraction electrodes 5 and the cathodes 7 from a longer diameter or a length of a longer side of each of the electron passage windows 6 of the extraction electrodes 5. The cold cathode display device according to the eighth preferred embodiment provides for suppression of divergence of electrons when they pass through the electron passage windows 6, thereby avoiding degradation of focusing characteristics observed in the anodes 2. Thus, a cold cathode display device having a high image quality can be achieved.

9. NINTH PREFERRED EMBODIMENT

According to a ninth preferred embodiment, a size of each of the electron passage windows 6 of the extraction electrodes 5 is limited. A structure according to the ninth preferred embodiment is substantially equal to that described in the first preferred embodiment and illustrated in FIG. 1. The extraction electrodes 5 arranged in stripes are provided over the back substrate 9 on which the cathodes 7 are formed, so as to be orthogonal to the stripes of the cathodes 7. The extraction electrodes 5 are provided with the electron passage windows 6, and the extraction electrodes 5 are disposed such that the electron passage windows 6 are located on the cathodes 7. The extraction electrodes 5 are attached to, and supported by, the barriers 8 via glass frit. In each of the extraction electrodes 5, more than one electron passage window 6 of the extraction electrodes is provided at each position for one pixel. One pixel includes approximately 10 electron passage windows 6 of the extraction electrodes. The electron passage windows 6, each with a 100 μm-long longer side and a 20 μm-shorter side, are arranged so as to have a pitch of 60 μm. Further, a width of each of the cathodes 7 is 100 μm in the ninth preferred embodiment.

Figure 19:
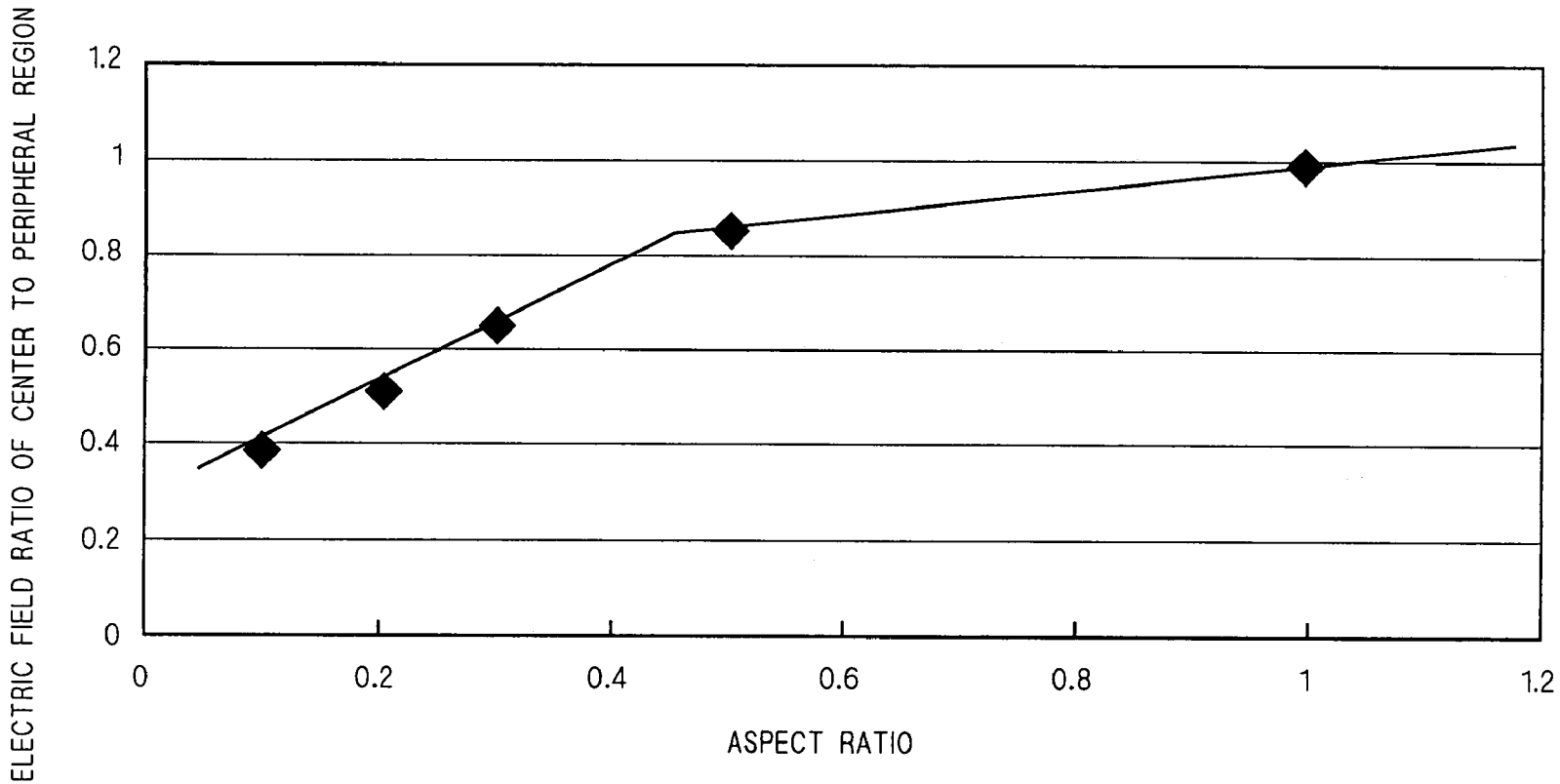
FIG. 19 is a view for showing a relationship between a relationship between a ratio of an electric field of a center to an electric field of a peripheral region and an aspect ratio according to a ninth preferred embodiment of the present invention.

According to the ninth preferred embodiment, a distribution of an electric field on each of the cathodes 7 is determined by varying a distance between the extraction electrodes 5 and the cathodes 7. An electric field on each of the cathodes 7 distributes such that it becomes strongest in a peripheral region of each aperture of the extraction electrodes 5 and becomes weaker in a region closer to a center of each aperture of the extraction electrode 5. FIG. 19 shows a relationship between a ratio of an electric field strength of a center to an electric field strength of a peripheral region, of one aperture, and a ratio of the distance between the extraction electrodes 5 and the cathodes 7 to a length of a shorter side of each of the electron passage windows 6 (this ratio will hereinafter be referred to as an "aspect ratio").

As shown in FIG. 19, when the aspect ratio is equal to, or larger than, 0.5, the ratio of an electric field strength of the center to an electric field strength of the peripheral region becomes equal to 0.9 or larger, so that respective electric field strengths on the cathodes 7 become equal to one another to some degree. Thus, in a cold cathode display device, satisfactory electron emission becomes possible.

In a cold cathode display device according to the ninth preferred embodiment, each of the extraction electrodes 5 is provided with more than one electron passage window 6 which is non-circular or rectangular. A longer diameter or a length of a longer side of each of the electron passage windows 6 is orthogonal to a lengthwise direction of each of the cathodes 7, and a shorter diameter or a length of a shorter side of each of the electron passage windows 6 is equal to, or larger than, a half of a distance between the cathodes 7 and the extraction electrodes 5. The cold cathode display device provides for a uniform electric field strength on the cathodes 7. Thus, a cold cathode display device capable of satisfactorily emitting electrons can be achieved.

While the invention has been shown and described in detail, the foregoing description is in all aspects illustrative and not restrictive. It is therefore understood that numerous modifications and variations can be devised without departing from the scope of the invention.

The invention claimed is:

1. A cold cathode display device comprising:

a first and second substrates disposed opposite each other with a space therebetween which is evacuated, at least a display portion of said second substrate, serving as a display surface, being transparent;

a light emitting part disposed at a predetermined position on a side of said second substrate on which the space is located, said light emitting part including a positive electrode and phosphors on said positive electrode;

an electron emitting part disposed on a side of said first substrate on which the space is located, opposite said light emitting part, said electron emitting part emitting an electron upon application of a predetermined potential;

an extraction electrode located between said electron emitting part and said light emitting part, for controlling the electron emitted from said electron emitting part, wherein width of said electron emitting part is equal to a length obtained by subtracting twice the distance between said extraction electrode and said electron emitting part from a longer diameter of a passage window in said extraction electrode; and a focus electrode located between said light emitting part and said extraction electrode, said focus electrode including windows through which the electron emitted from said electron emitting part passes.

2. The cold cathode display according to claim 1, wherein said focus electrode is a plate-shaped material, and said windows in said plate-shaped material form a grid including elongate rectangles.

3. The cold cathode display device according to claim 1, wherein said focus electrode includes a multiplicity of lines, and said windows are arranged in stripes defined by said multiplicity of lines, said lines being parallel to, and spaced from, one another.

4. The cold cathode display device according to claim 1, wherein each of said windows in said focus electrode has a non-circular or rectangular shape, said extraction electrode includes passage windows having a non-circular or rectangular shape, a longer diameter or a longer side of each of said windows in said focus electrode is parallel to a longer side of each of said phosphors included in said light emitting part, and is orthogonal to a longer diameter or a longer side of each of said non-circular or rectangular passage windows located in said extraction electrode, and more than one of said passage windows is provided for each of said windows in said focus electrode.

5. The cold cathode display device according to claim 4, wherein a shorter diameter or a length of a shorter side of each of said windows in said focus electrode is smaller than twice the thickness of said focus electrode.

6. The cold cathode display device according to claim 1, wherein a distance d between said focus electrode and said electron emitting part is correlated with a distance D between said electron emitting part and said positive electrode, a width w of said electron emitting part, a pitch W of said phosphors, and a voltage Va on said positive electrode, having a relationship of $(D/d-1)\times w\times(9/Va)^{1/2}/W<22$.

7. The cold cathode display device according to claim 1, wherein said extraction electrode includes a plurality of non-circular or rectangular passage windows in one pixel, and said passage windows are arranged in a line parallel to a direction in which said electron emitting part extends, where said extraction electrode and said electron emitting part intersect each other.

8. The cold cathode display device according to claim 1, wherein said extraction electrode includes a plurality of non-circular or rectangular passage windows, a longer diameter or a longer side of each of said passage windows is orthogonal to a lengthwise direction of said electron emitting part, and a shorter diameter or a length of a shorter side of each of said passage windows is equal to, or larger than, one half the distance between said electron emitting part and said extraction electrode.

9. A cold cathode display device comprising:

a first and second substrates disposed opposite each other with a space therebetween which is evacuated, at least a display portion of said second substrate, serving as a display surface, being transparent;

a light emitting part disposed at a predetermined position on a side of said second substrate on which the space is located, said light emitting part including a positive electrode and phosphors on said positive electrode;

an electron emitting part disposed on a side of said first substrate on which the space is located, opposite said light emitting part, said electron emitting part emitting an electron upon application of a predetermined potential;

an extraction electrode located between said electron emitting part and said light emitting part, for controlling the electron emitted from said electron emitting part; and a focus electrode located between said light emitting part and said extraction electrode, said focus electrode including windows through which the electron emitted from said electron emitting part passes, wherein an interval WG between adjacent windows in said extraction electrode is correlated with a distance dFG between said focus electrode and said extraction electrode, a voltage VF on said focus electrode, and a voltage VG on said extraction electrode, and $WG>VF/abs(VF-VG)\times dFG$, each of the voltages VF and VG being set by using a voltage on said electron emitting part as a reference.

* * * * *